US007265730B2

(12) United States Patent
Iizuka et al.

(10) Patent No.: US 7,265,730 B2
(45) Date of Patent: Sep. 4, 2007

(54) DIPOLE ANTENNA HAVING A PERIODIC STRUCTURE

(75) Inventors: Hideo Iizuka, Nisshin (JP); Peter S Hall, Birmingham (GB)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 6 days.

(21) Appl. No.: 11/376,267

(22) Filed: Mar. 16, 2006

(65) Prior Publication Data

US 2006/0208957 A1 Sep. 21, 2006

(30) Foreign Application Priority Data

Mar. 18, 2005 (JP) ..... 2005-080056
Aug. 5, 2005 (JP) ..... 2005-228886

(51) Int. Cl.
*H01Q 9/16* (2006.01)

(52) U.S. Cl. ..... 343/802; 343/793

(58) Field of Classification Search ..... 343/793, 343/795, 802, 803, 810, 812
See application file for complete search history.

(56) References Cited

U.S. PATENT DOCUMENTS 3,277,487 A * 10/1966 Berry et al. ..... 343/722
6,661,392 B2 12/2003 Isaacs et al.
6,859,114 B2 2/2005 Eleftheriades et al.
6,965,353 B2 * 11/2005 Shirosaka et al. ..... 343/802

OTHER PUBLICATIONS

Lei Liu, et al., "Dominant Mode Leaky-wave Antenna With Backfire-to-endfire Scanning Capability", Electronics Letters, vol. 38, No. 23, Nov. 7, 2002, 2 pages.

* cited by examiner

*Primary Examiner*—Hoang V. Nguyen
(74) *Attorney, Agent, or Firm*—Oblon, Spivak, McClelland, Maier & Neustadt, P.C.

(57) ABSTRACT

A dipole antenna includes a plurality of generally parallel metal wiring lines, and a plurality of identical or similar unit circuits arranged in a row along the extending direction of the metal wring lines and connected with one another. Each unit circuit includes a connection portion for connecting the metal wiring lines together via at least one first inductor, and at least one first capacitor inserted into at least one of the metal wiring lines. The plurality of unit circuits are identical unit circuits. Alternatively, the plurality of unit circuits include unit circuits operable in the right-hand system and unit circuits operable in the left-hand system.

37 Claims, 21 Drawing Sheets

【FIG.1】
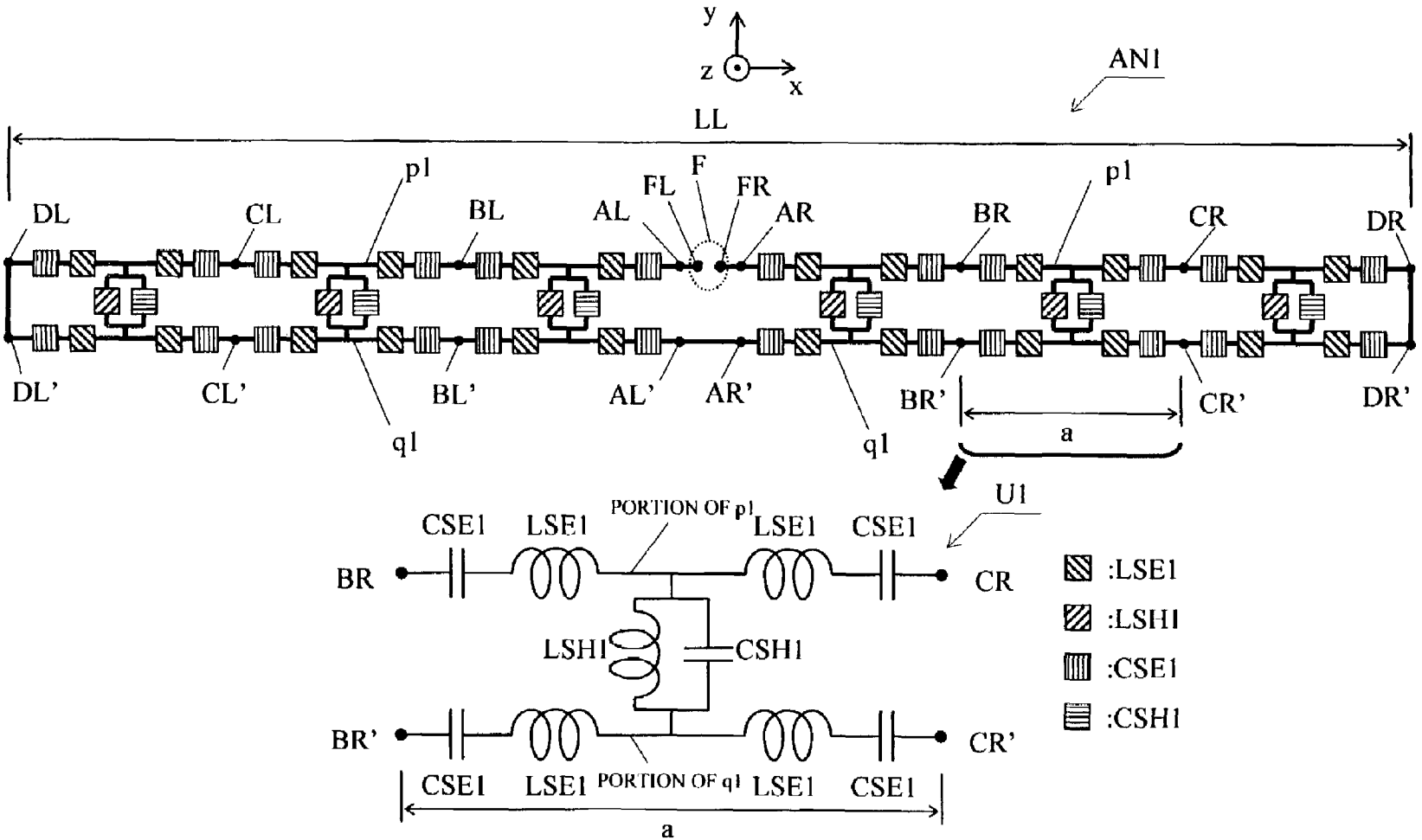

【FIG.2A】
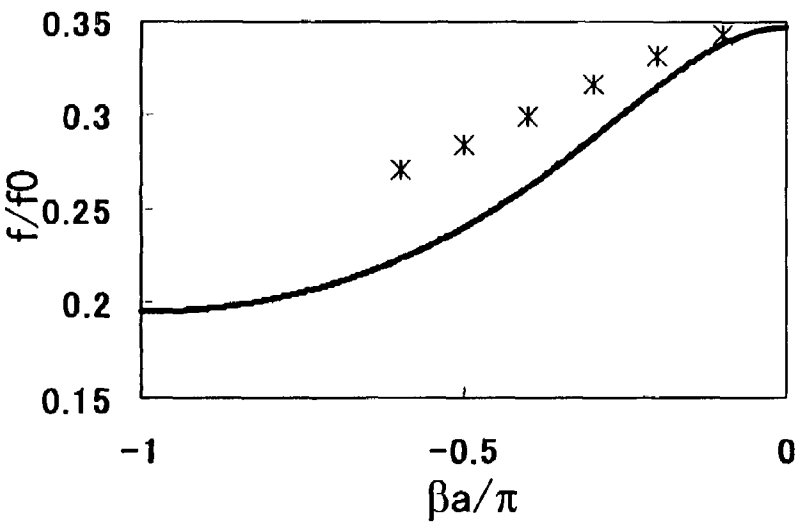
【FIG.2B】
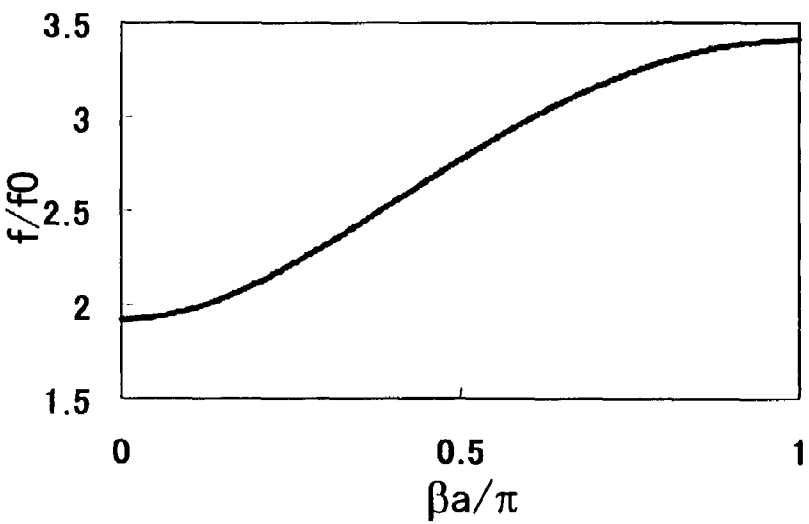

【FIG.3A】
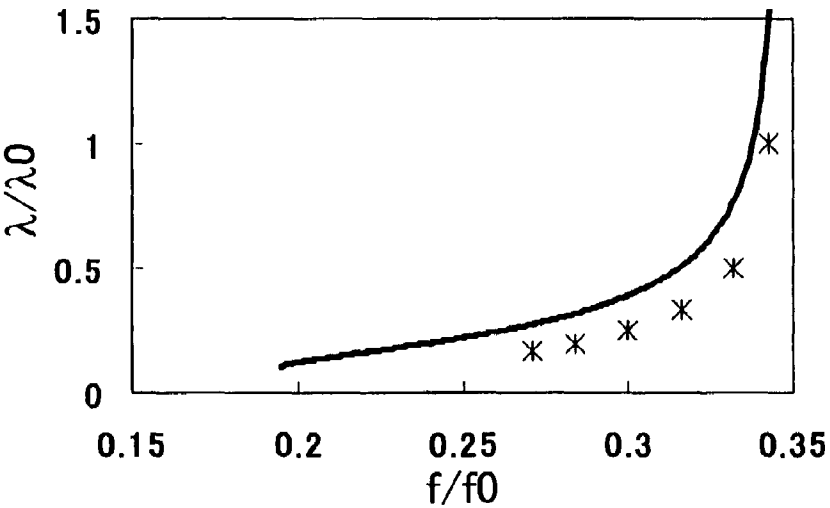
【FIG.3B】
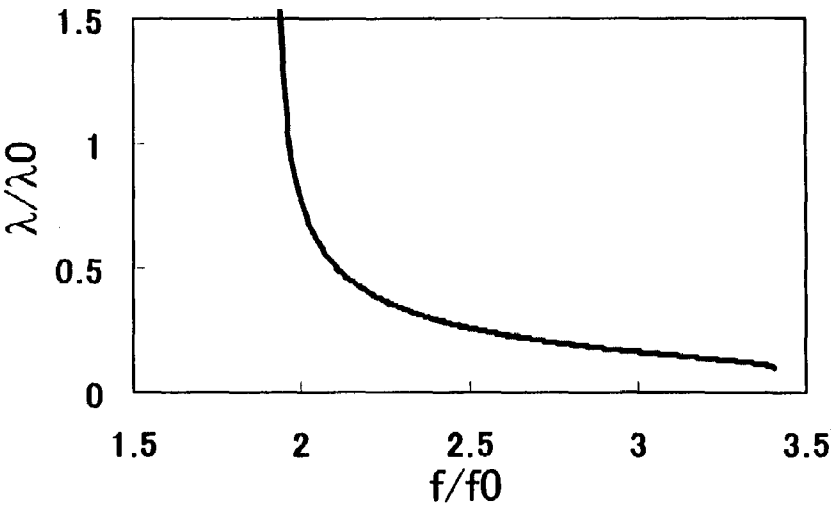

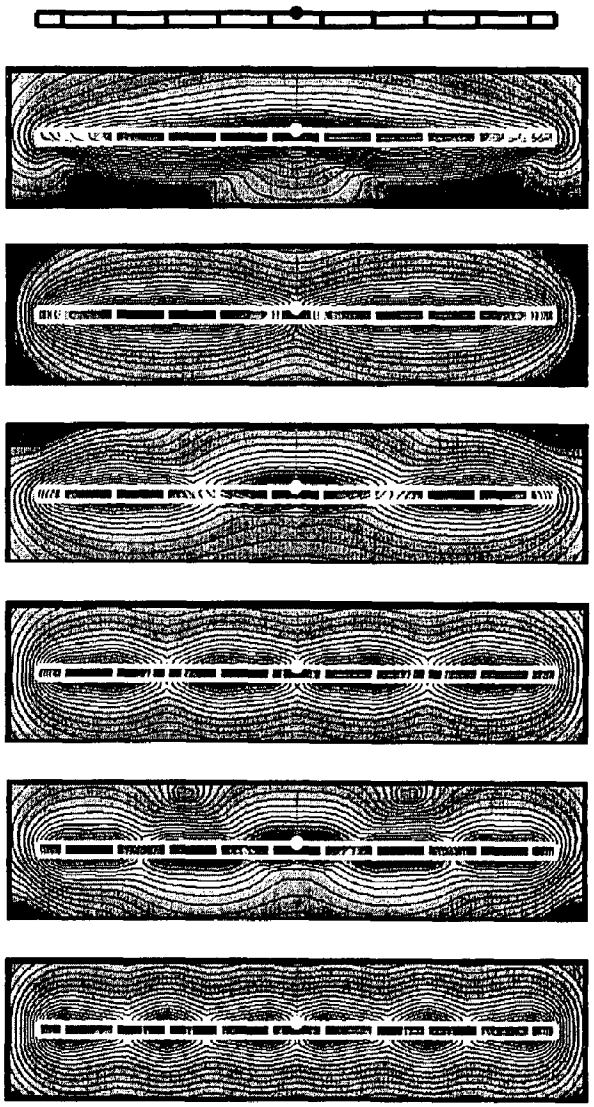
【FIG.4A】 n=-1, f=0.343f0
【FIG.4B】 n=-2, f=0.332f0
【FIG.4C】 n=-3, f=0.316f0
【FIG.4D】 n=-4, f=0.3f0
【FIG.4E】 n=-5, f=0.284f0
【FIG.4F】 n=-6, f=0.271f0

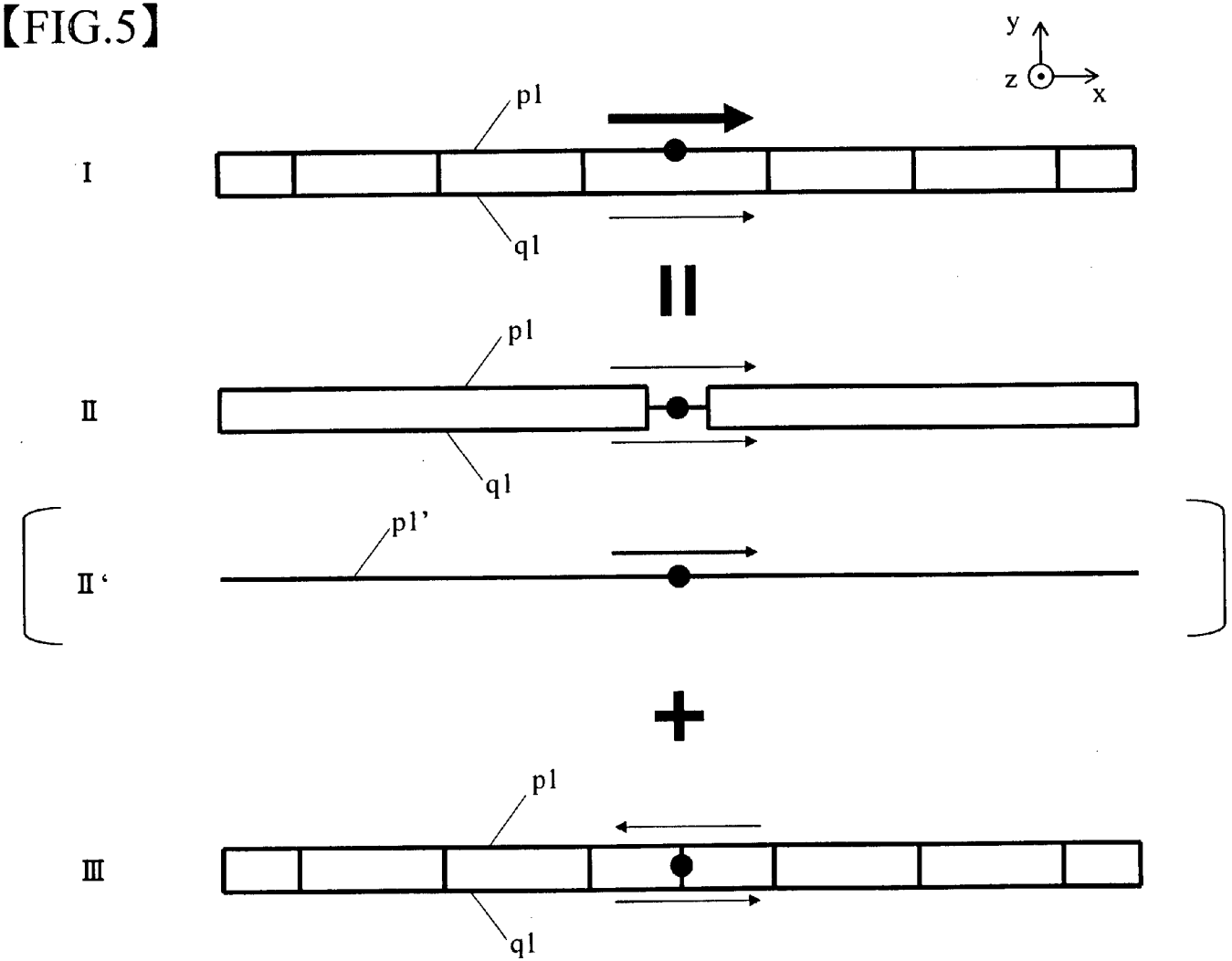
【FIG.5】

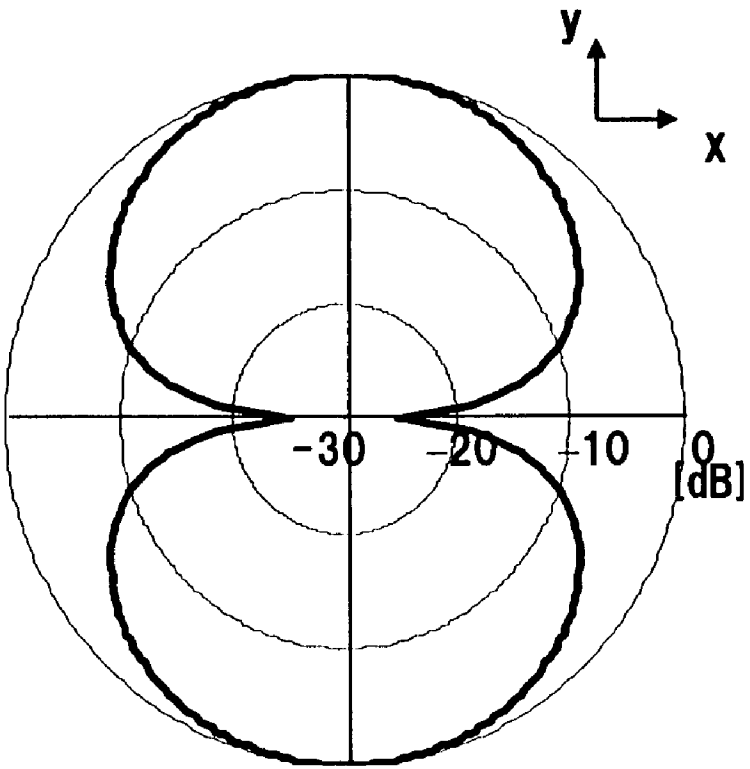
【FIG.6】

【FIG.7】
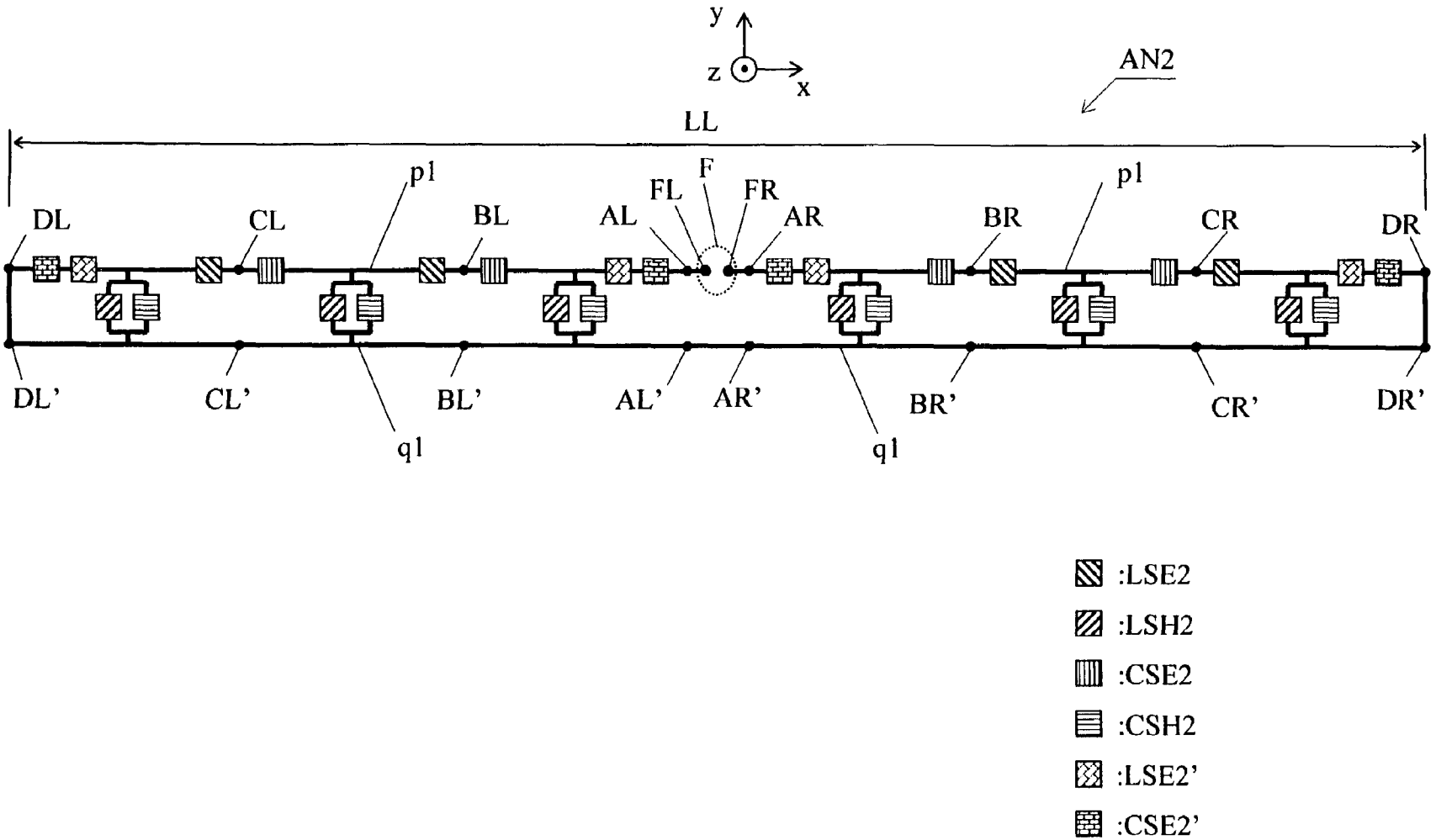

【FIG.8】
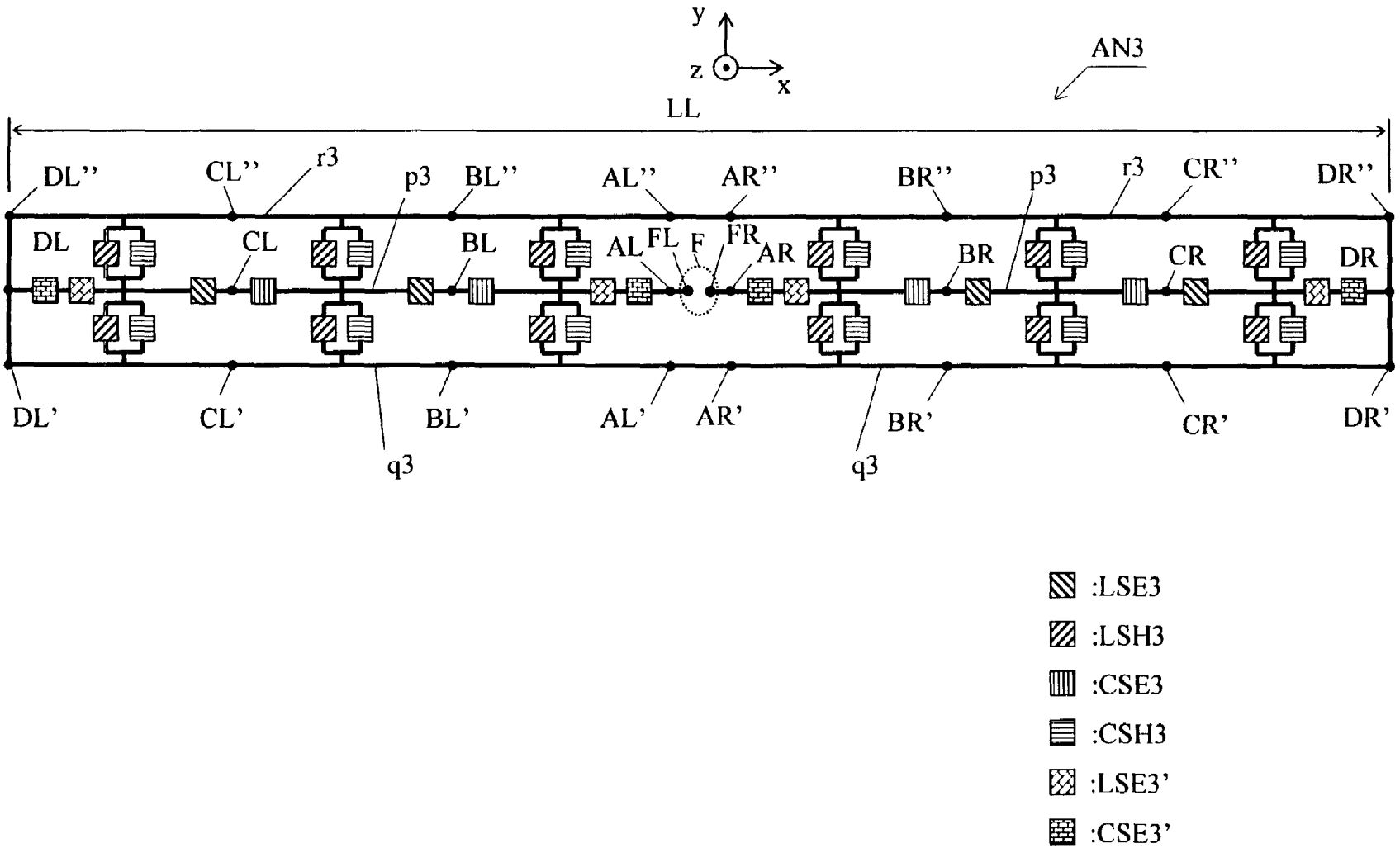

【FIG.9】
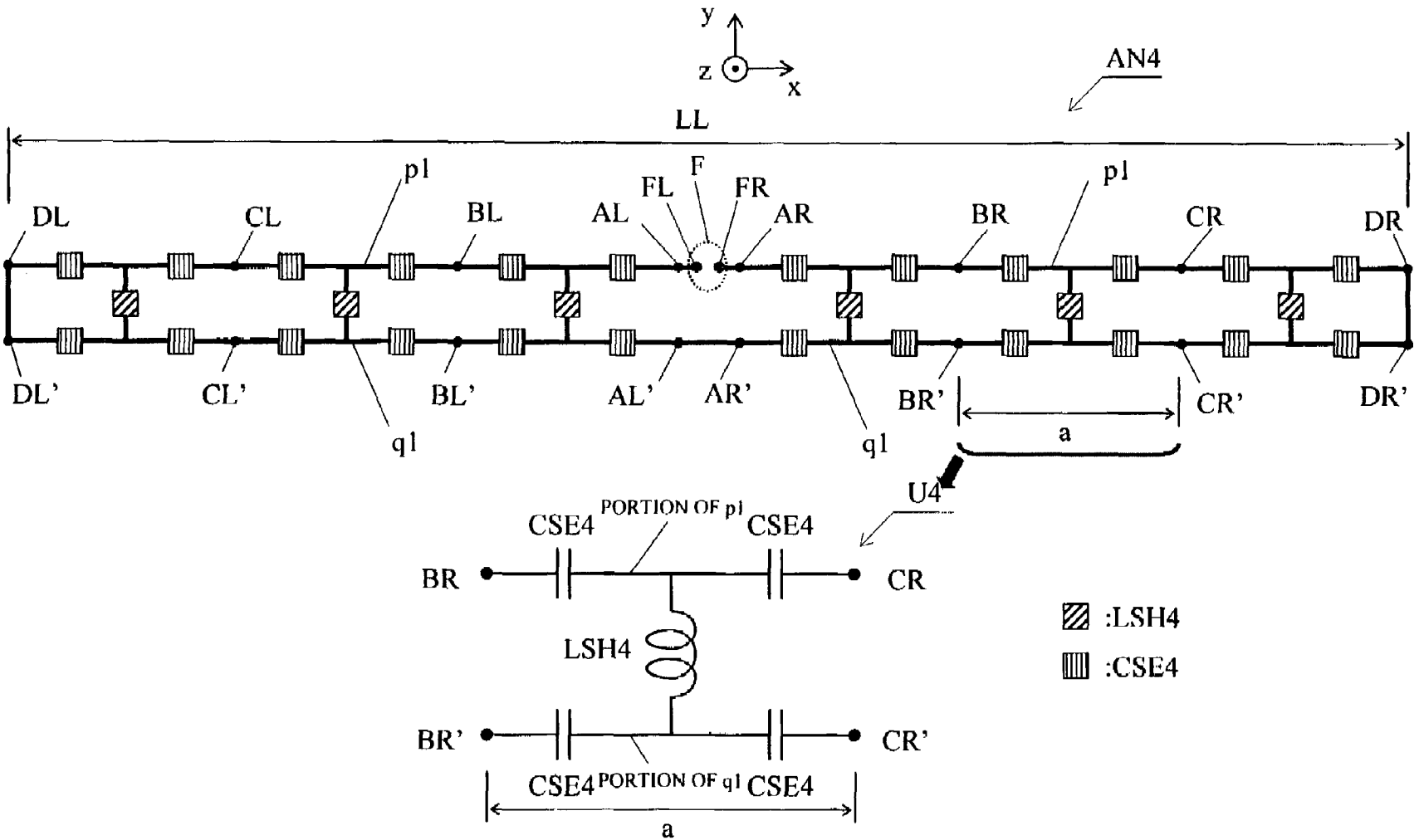

【FIG.10】
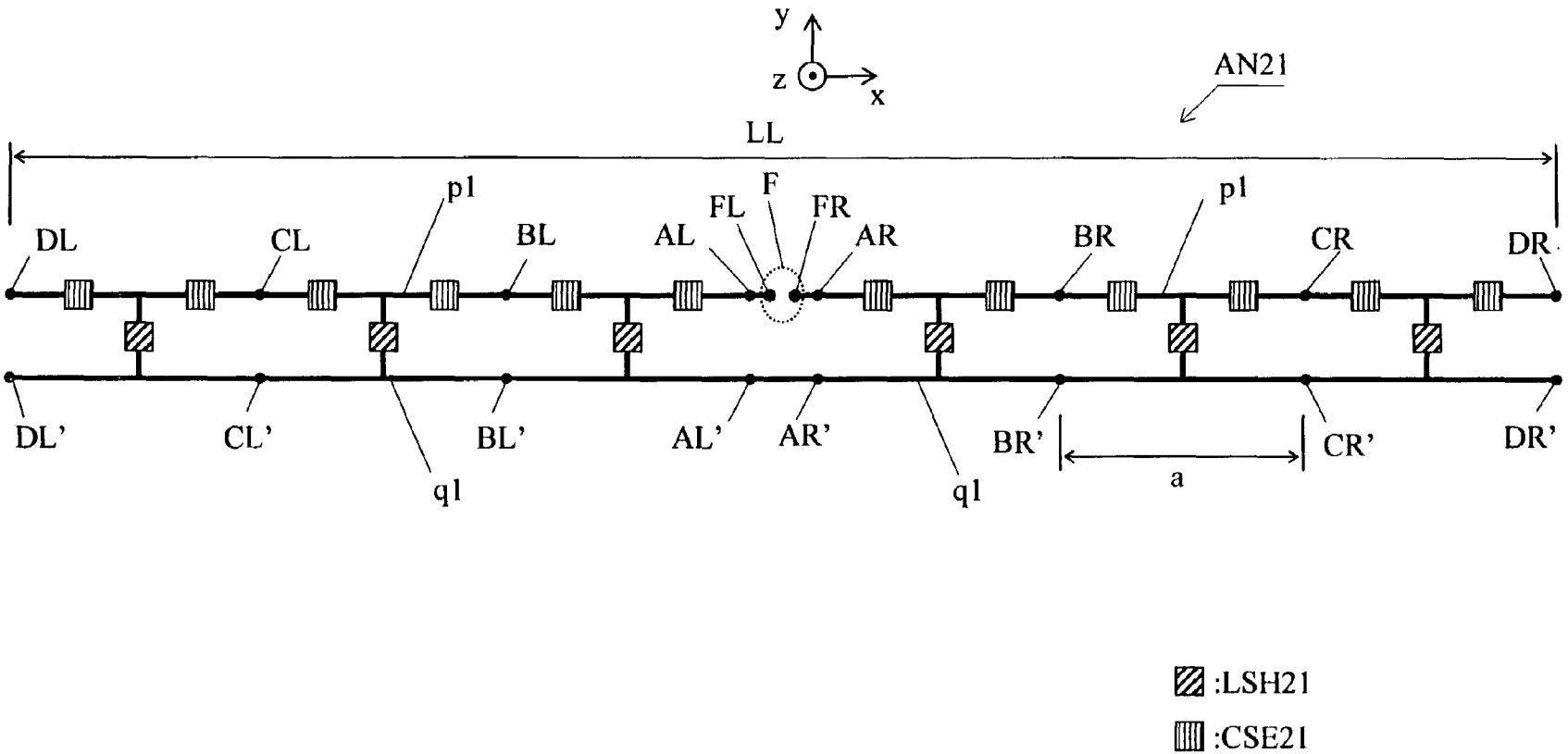

【FIG.11】
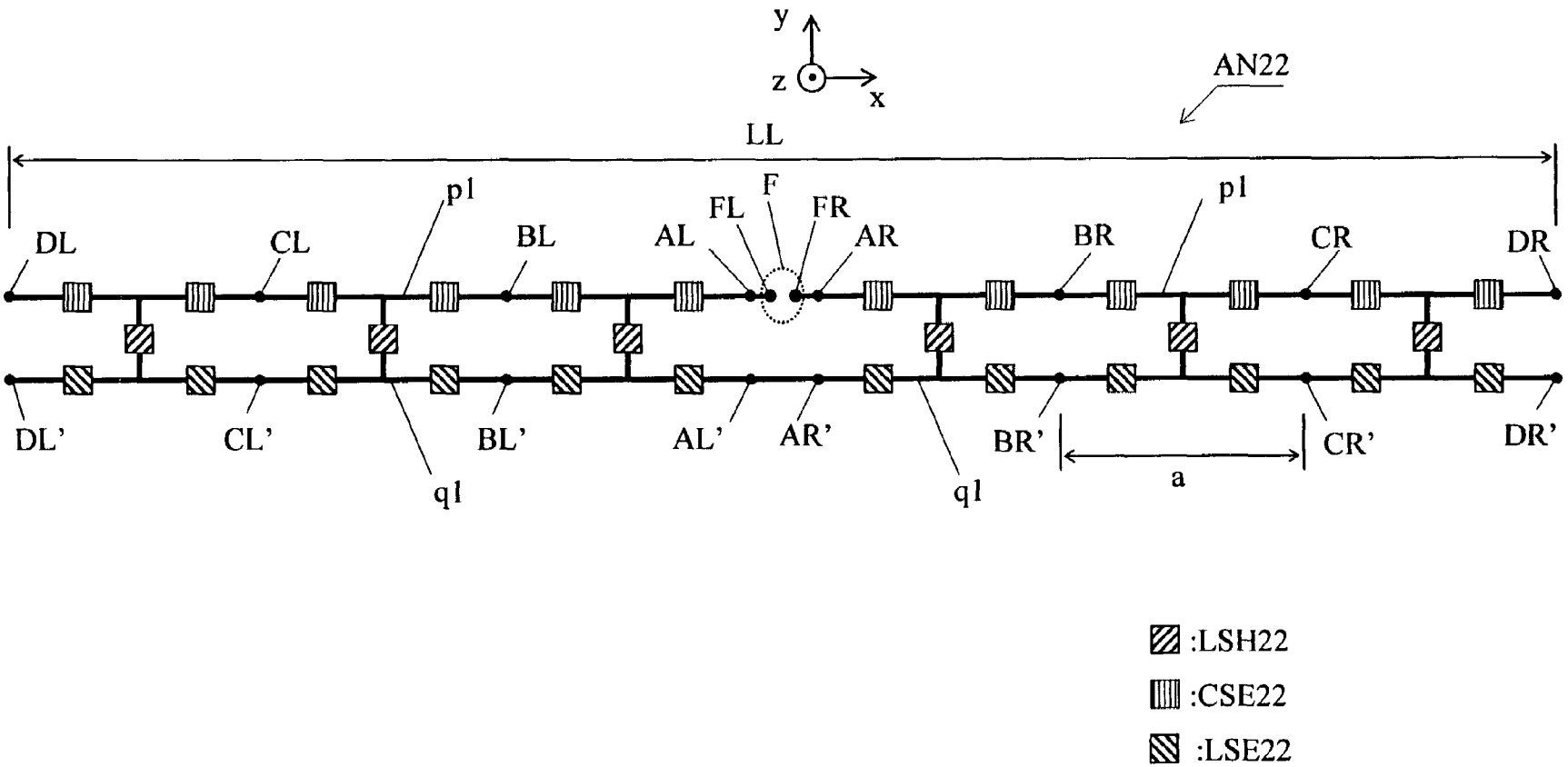

【FIG.12】
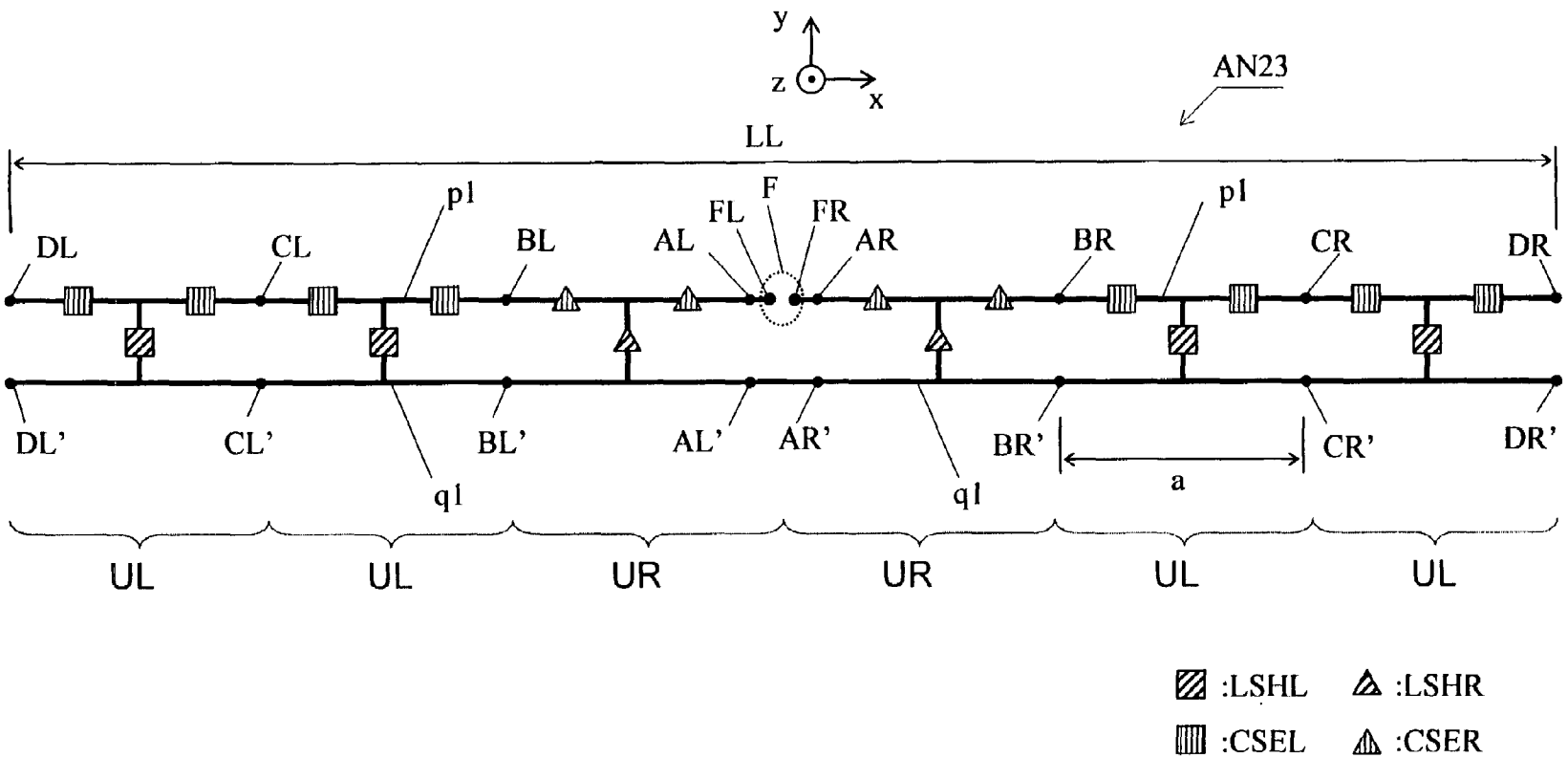

【FIG.13B】
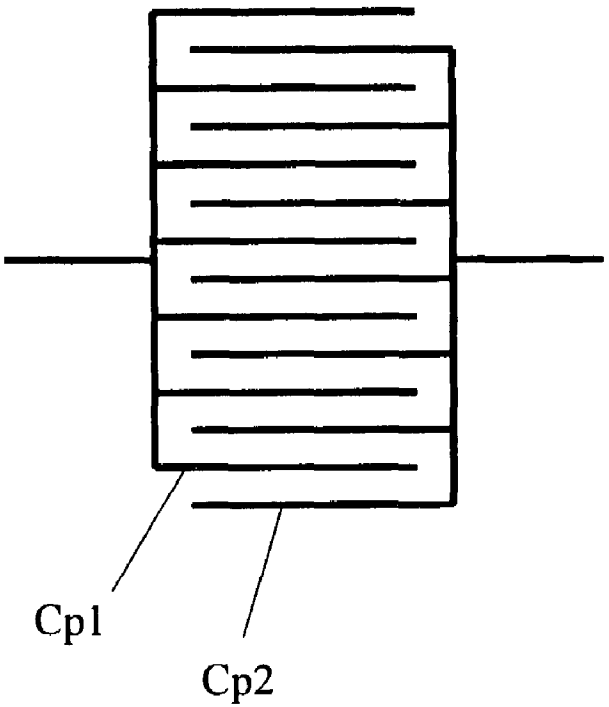
【FIG.13A】
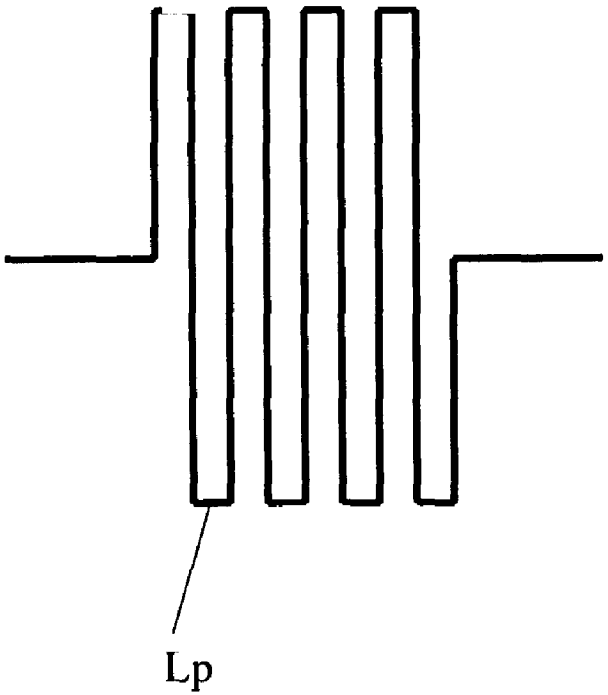

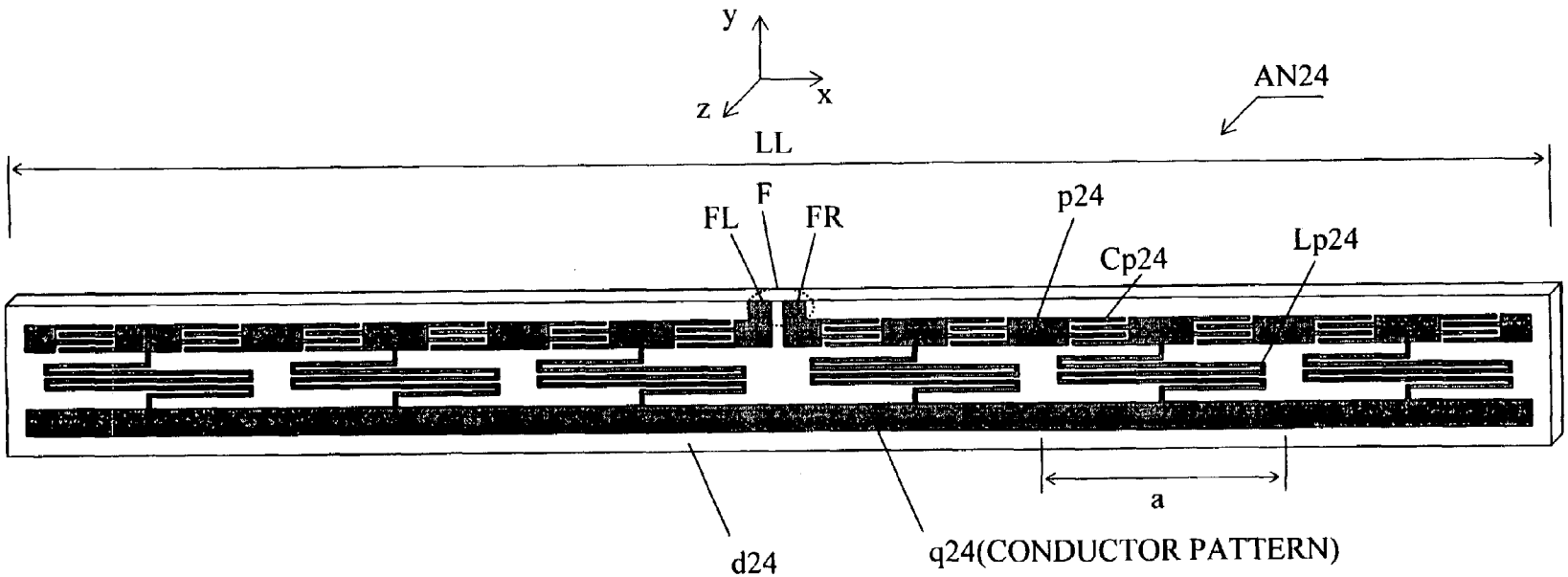
【FIG.14】

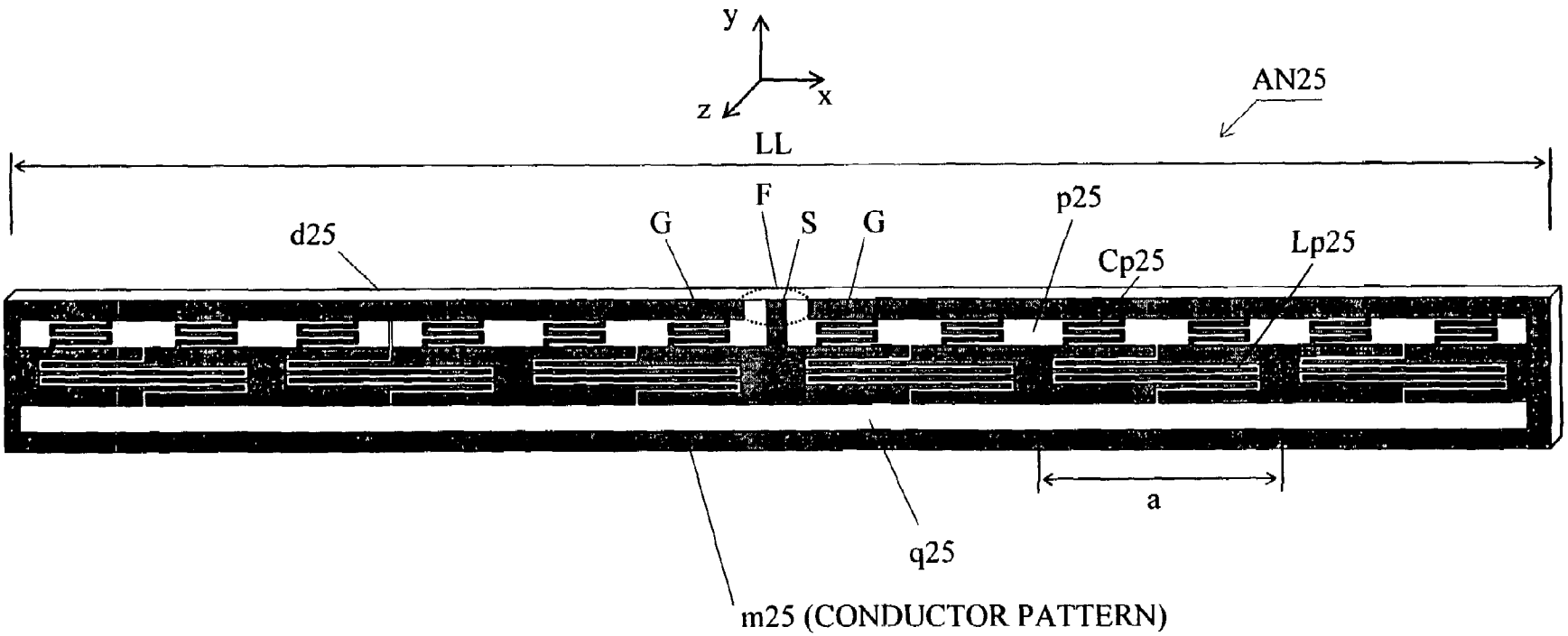
【FIG.15】

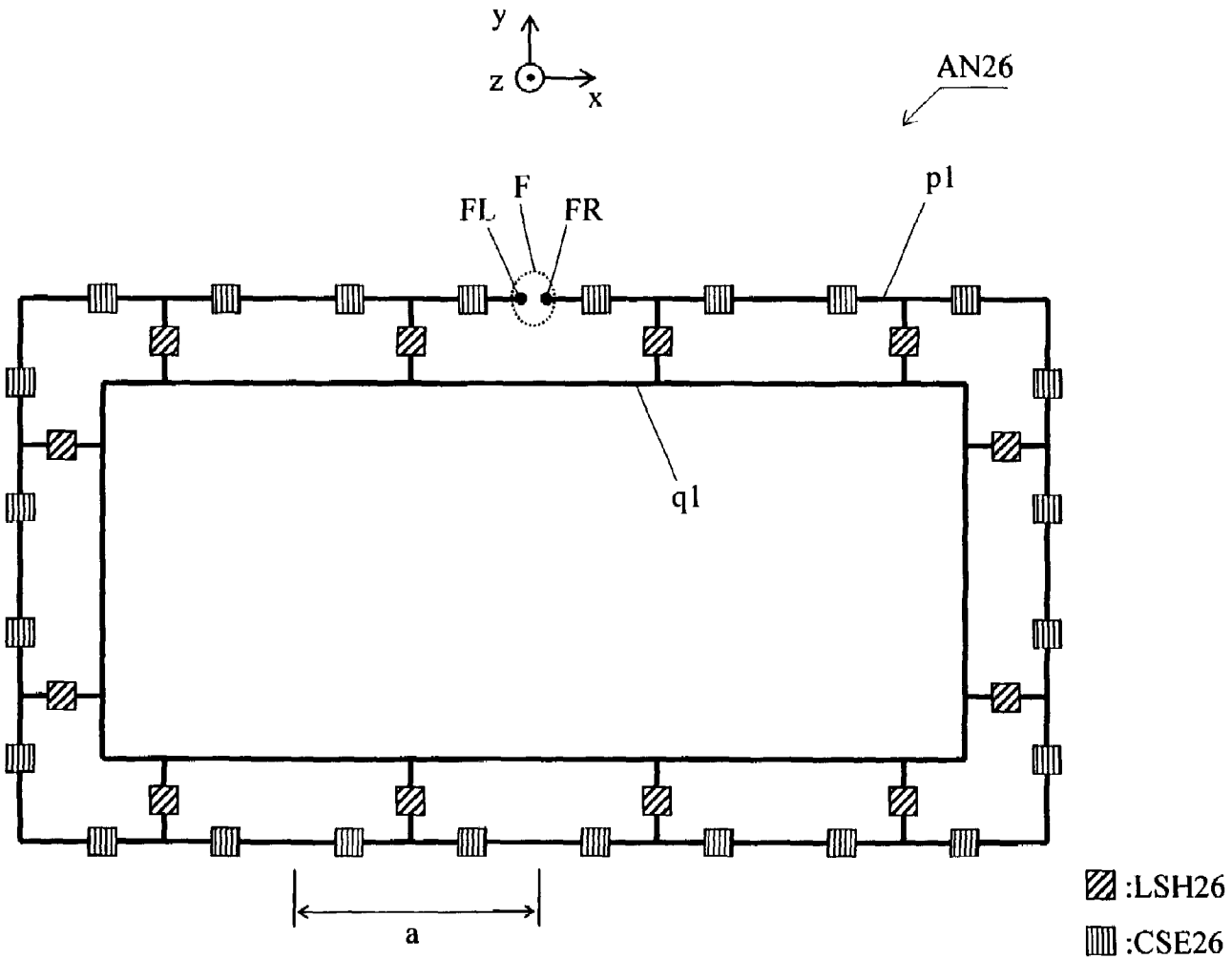
【FIG.16】

【FIG.17】
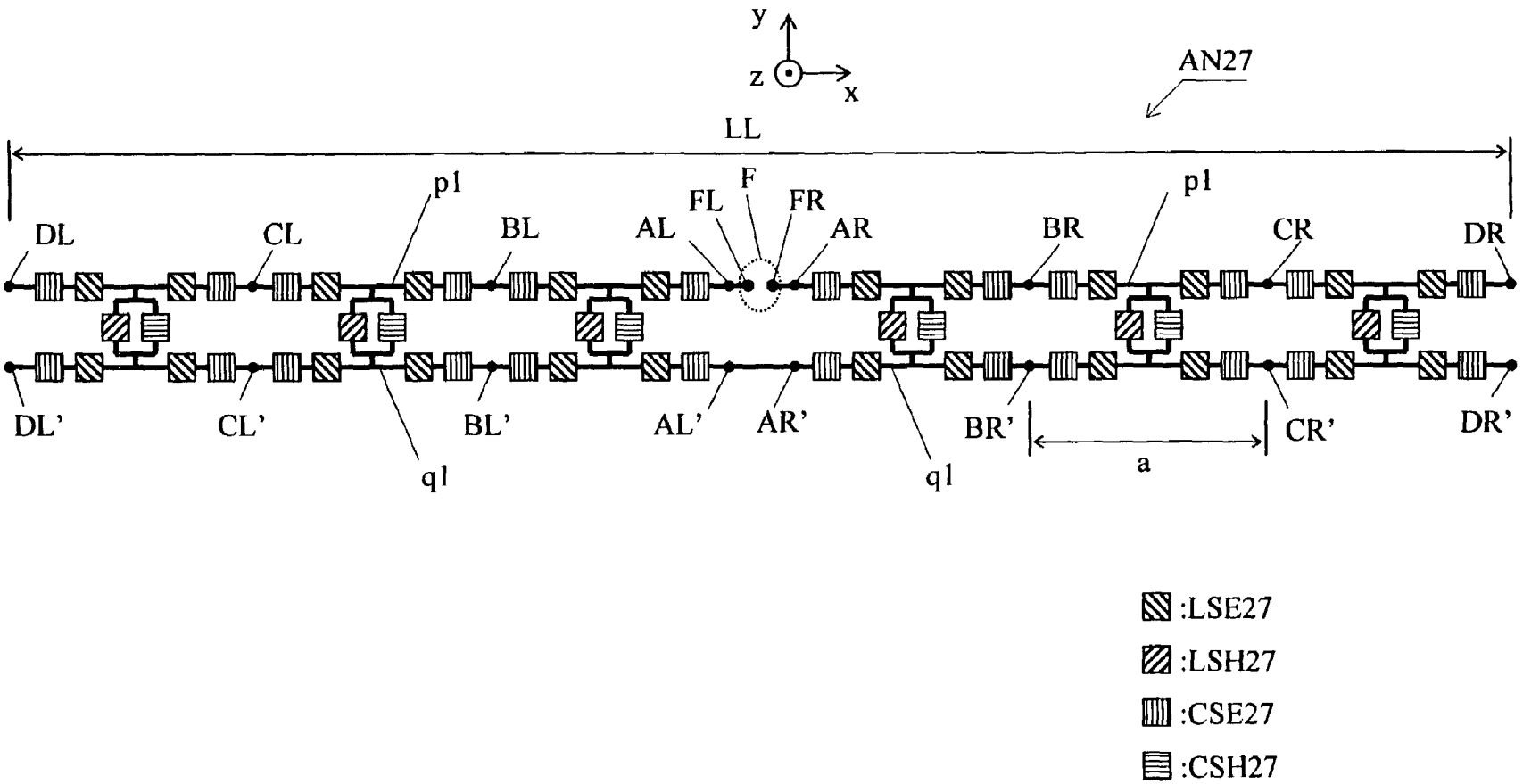

【FIG.18】
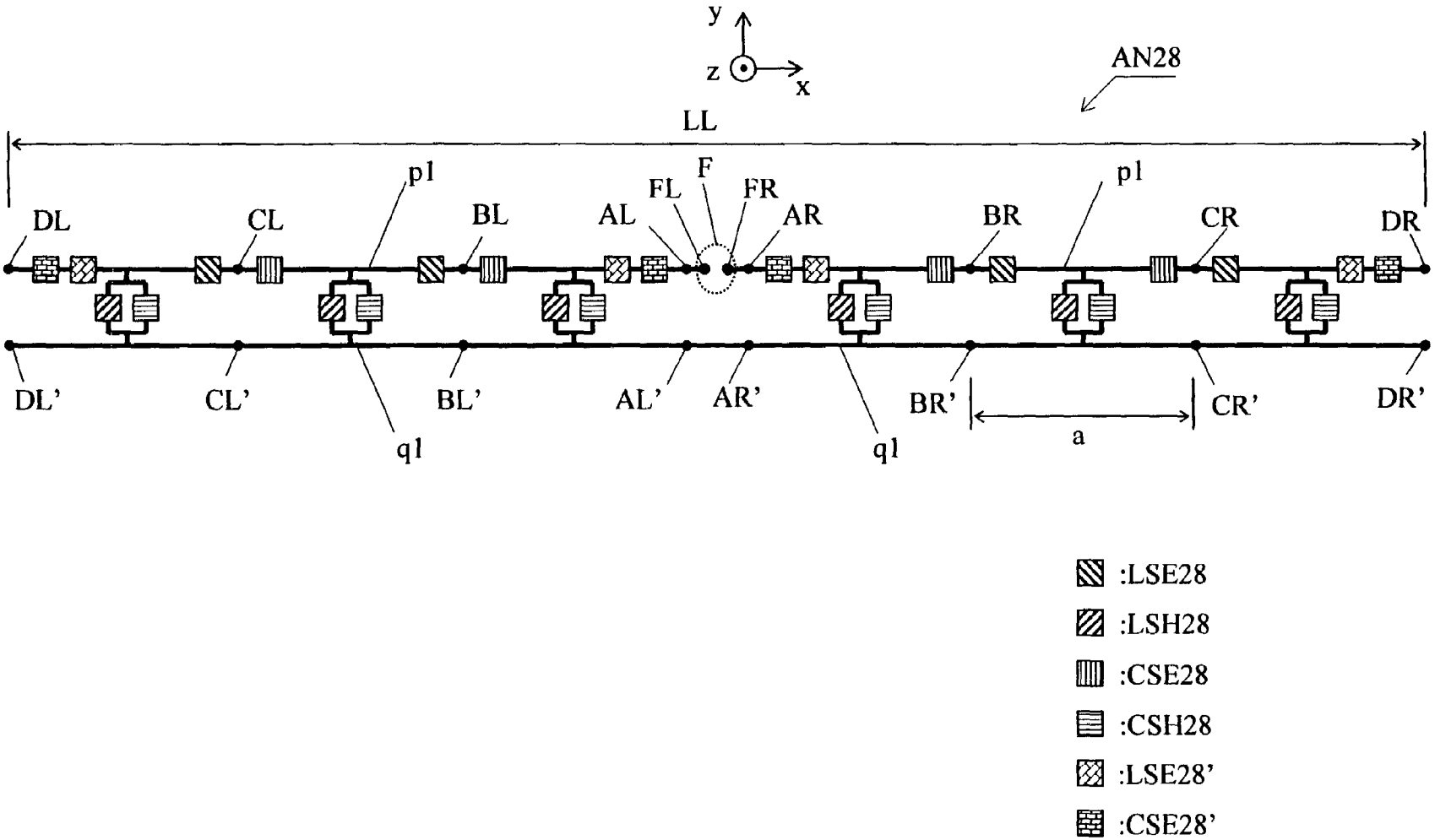

【FIG.19】
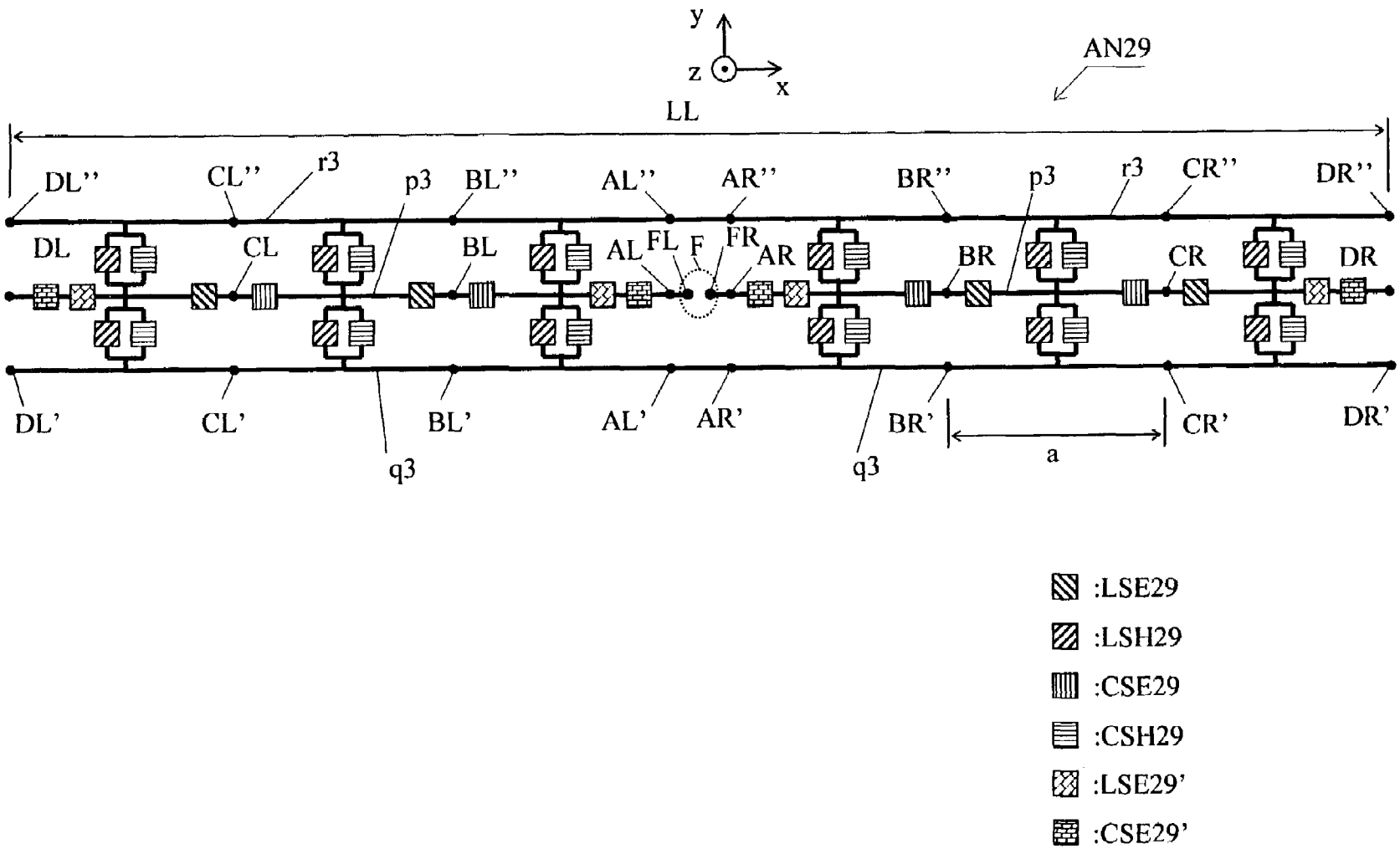

【FIG.20】
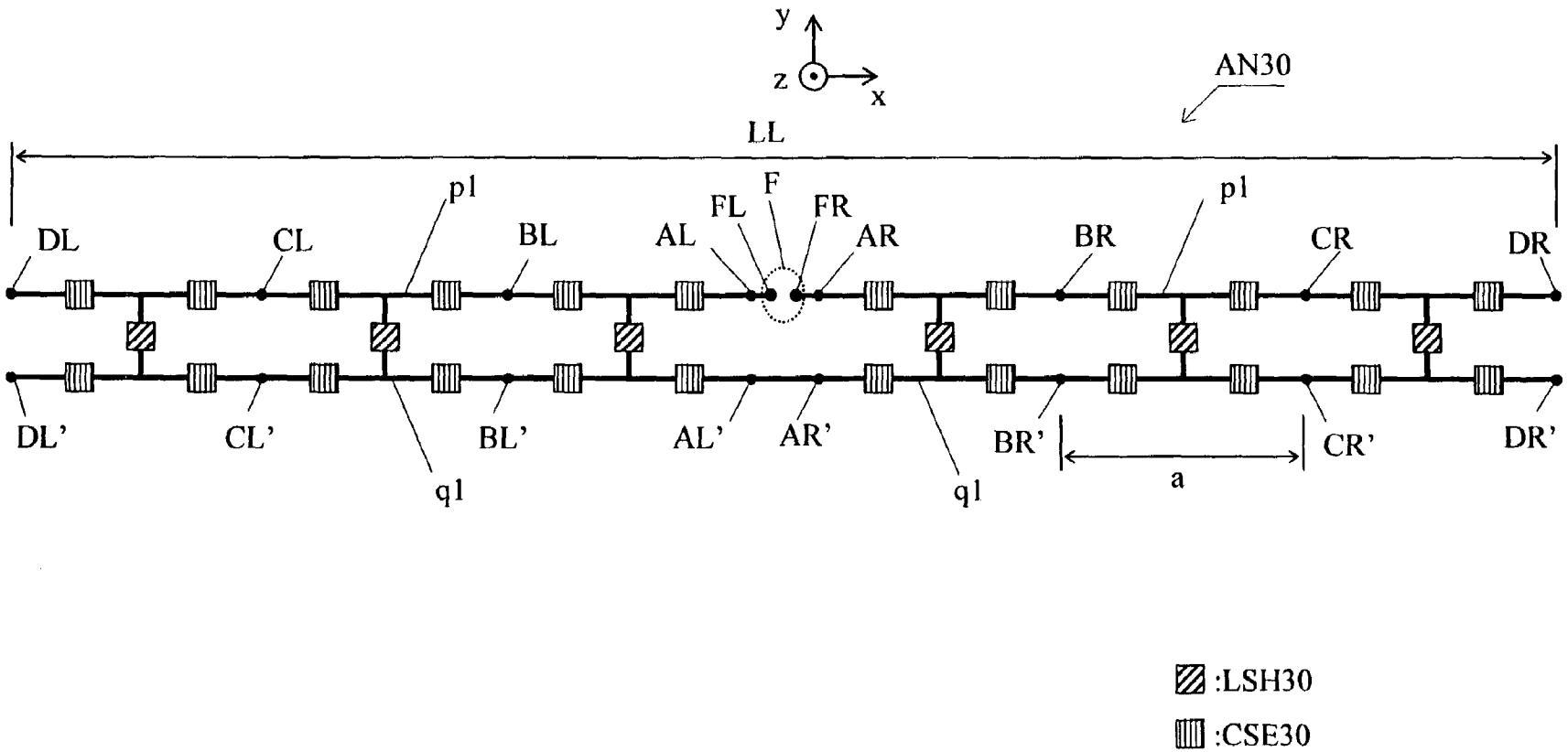

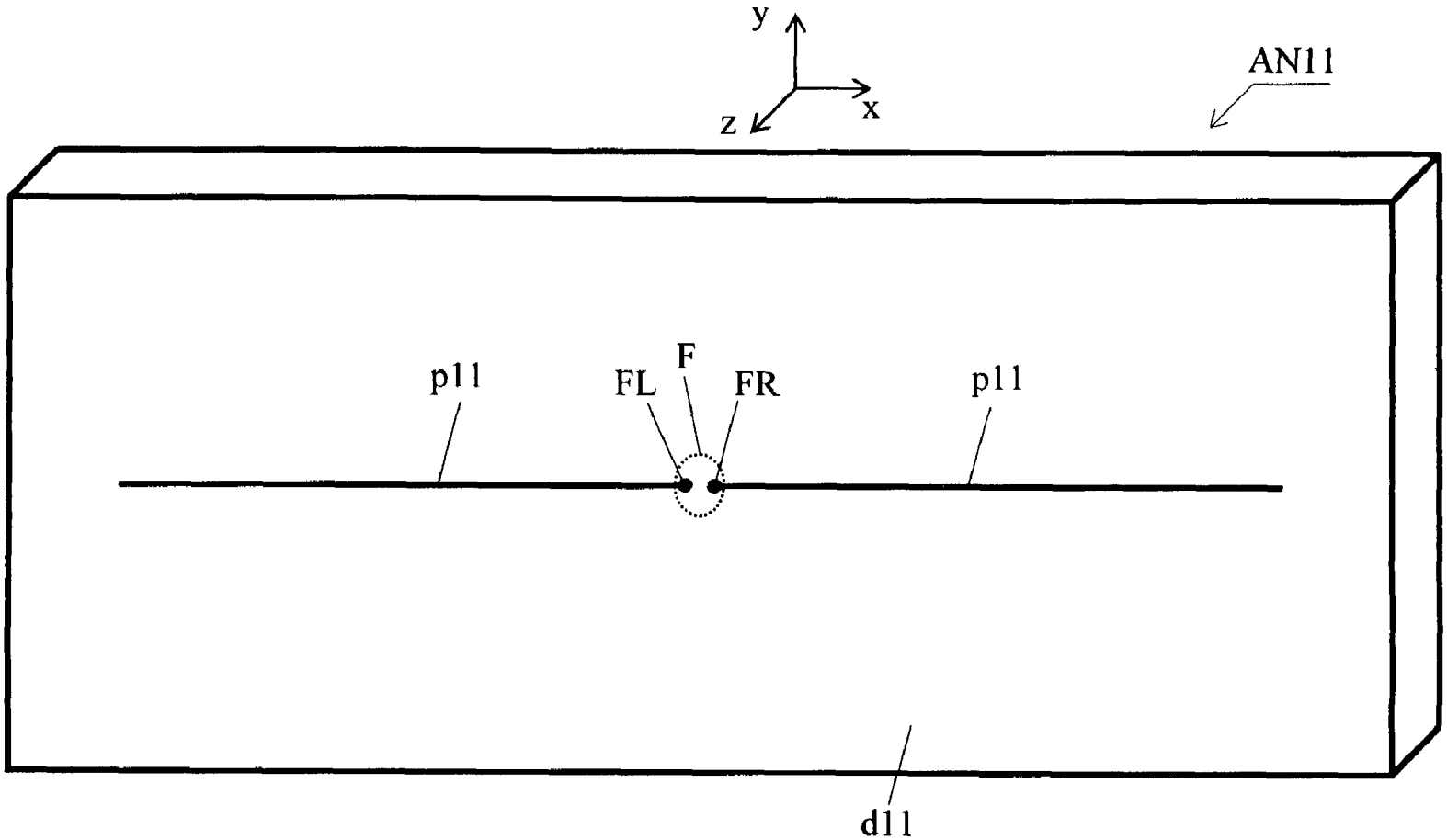
【FIG.21】

DIPOLE ANTENNA HAVING A PERIODIC STRUCTURE

BACKGROUND OF THE INVENTION

1. Field of the Invention

The present invention relates to a dipole antenna which includes a plurality of generally parallel metal wiring lines as a base structure and a plurality of identical or similar unit circuits arranged in a row along the extending direction of the metal wiring lines and connected to one another. The present invention also relates to a planar antenna and a loop antenna obtained through modification of such a dipole antenna.

The present invention is considerably useful for reducing the size of an antenna having a periodic structure.

2. Description of the Related Art

FIG. 21 shows the structure of a dipole antenna AN11 of reduced size according to a conventional technique. A metal wiring line p11, which has at its center a feeding portion F composed of two feeding points FL and FR, is disposed on one surface of a dielectric substrate d11. In this structure, due to the wavelength-shortening effect of the dielectric substrate d11, the antenna length of the dipole antenna AN11; i.e., the length of the metal wiring line p11, can be shortened, and the antenna resonates when its antenna length becomes $\alpha d \cdot |n|/2$ times the free-space wavelength of electromagnetic waves to be handled, where $\alpha d$ is the shortening ratio for the antenna length, and assumes a value between 0 and 1 depending on the dielectric constant and the z-direction thickness of the dielectric substrate. Further, n is a natural number corresponding to each resonation mode, and the mode of n=1 is typically used, because the antenna length can be shortened to the greatest degree.

Another known antenna in which inductors and capacitors are disposed periodically so as to utilize the left-hand-system phenomenon in which the direction of the group velocity becomes opposite that of the phase velocity in propagation of electromagnetic waves is described in L. Lei, C. Caloz, T. Ito, et. al., "Dominant mode leaky wave antenna with backfire to endfire scanning capability," Electron. Lett., vol. 38, no. 23, pp. 1414-1416, November 2002. This literature discloses other application forms regarding the left-hand-system phenomenon (an invention relating to an improved leaky wave antenna) and the operation principle of the antenna regarding the left-hand-system.

The first-mentioned conventional technique has a drawback as follows. Since the antenna length shortening ratio $\alpha d$ is determined by the dielectric constant and thickness of an individual dielectric substrate, setting the shortening ratio $\alpha d$ to an arbitrary value is not necessarily easy.

At 100 MHz, for example, a half-wavelength dipole (n=1) placed in a free space has a length of 1.5 m. In the case where the antennal length of such a half-wavelength dipole is shortened in accordance with the conventional technique, a dielectric substrate having a high dielectric constant and a large thickness of about 10 to 50 cm becomes necessary.

Such a dielectric substrate is difficult to manufacture at low cost, and such an antenna can be installed only at limited locations.

SUMMARY OF THE INVENTION

The present invention was accomplished in order to solve the above-described problems, and an object of the present invention is to provide a dipole antenna which can be easily reduced in size.

In order to achieve the above object, the present invention provides a dipole antenna comprising a plurality of generally parallel metal wiring lines; and a plurality of identical or similar unit circuits arranged in a row along the extending direction of the metal wring lines and connected with one another, wherein each unit circuit includes a connection portion for connecting the metal wiring lines together via at least one first inductor, and at least one first capacitor inserted into at least one of the metal wiring lines.

Examples of the similar unit circuits include symmetrical circuits obtained through symmetric conversion such as axisymmetric conversion, point-symmetric conversion, or rotary-symmetric conversion.

Unit circuits which are disposed in the vicinity of the center or ends of the antenna and which are located adjacent to or include the feeding portion or poles (end portions) of the antenna may differ from the remaining unit circuits in terms of input/output boundary conditions. The above-described similar unit circuits may be unit circuits having been slightly modified or having capacitances adjusted so as to cope with the specific boundary conditions at such specific points. Accordingly, such similar unit circuits may be disposed at the center or ends of the dipole antenna.

When the total number of the parallel metal wiring lines that constitute the base structure is m, each unit circuit must include m−1 connection portions, and each connection portion must include at least one first inductor as described above.

Stray inductances of the metal wiring lines themselves and stray capacitances present between the metal wiring lines also serve as circuit elements which constitute the above-described unit circuit. In other words, the equivalent circuit of the dipole antenna of the present invention is such that unit circuits each composed of an inductor and a capacitor connected in series and an inductor and a capacitor connected in parallel are arranged in a row along the longitudinal direction (i.e., the dipole direction) of the antenna and connected together.

Accordingly, the dipole antenna of the present invention can be designed by adjusting or optimizing the respective values (inductance and capacitance) in consideration of the stray components associated with the metal wiring lines.

According to the present invention, the length of the antenna can be freely set through selection of the respective values (inductance and capacitance) of the first inductor and the first capacitor disposed in the dipole antenna. The operation principle of the antenna is as follows.

When inductors and capacitors are arranged and connected in the above-described manner, the directions of the group velocity and the phase velocity in propagation of electromagnetic waves can be made opposite each other. This phenomenon is called a left-hand-system phenomenon. In the above-described circuit (dipole antenna of the present invention) involving such a left-hand-system phenomenon, the phase constant $\beta$, which is the imaginary part of the propagation constant, assumes a value of zero or smaller. When a graph which represents the frequency characteristic of the above-described circuit (dipole antenna of the present invention) is depicted, with the phase constant $\beta$ used as an independent variable (horizontal axis) and the resonance frequency f of the circuit as a dependent variable (vertical axis), its f-$\beta$ curve exhibits a monotonous increase in the second quadrant of the $\beta$ f coordinate system. Also, in the second quadrant, the f-$\beta$ curve extends from the upper side (a point on the vertical axis where $(\beta, f)=(0, f1)$; $f1>\delta\geqq 0$) and gradually approaches a straight line $f=\delta(\geqq 0)$ parallel to the horizontal-axis as the value of $\beta$ decreases (that is, as the absolute value $|\beta|$ of $\beta$ increases). $\delta$ is a positive constant specific to the circuit.

In other words, in the dipole antenna of the present invention, in the region where the value of the phase constant $\beta$ of the circuit becomes zero or smaller, the absolute value $|\beta|$ of the phase constant $\beta$ of the circuit can be increased by decreasing the resonance frequency f of the circuit from the above-described f1, with the non-negative constant $\delta$ used as a lower limit.

Meanwhile, the following relation exists between the wavelength $\lambda$ of a signal propagating along the circuit and the phase constant $\beta$ of the circuit.

$$\lambda=2\pi/|\beta| \quad (1)$$

Since the antenna length of a dipole antenna is represented by $|n|\lambda/2$, by virtue of the present invention, the length of a dipole antenna can be effectively reduced in a region where the frequency of a signal to be handled is low.

Although the above-mentioned shortening ratio $\alpha d$ can be set to a value equal to or greater than 1, in practice, the shortening ratio $\alpha d$ is desirably set to a value less than 1, from the viewpoint of size reduction.

According to the present invention, a desired dipole antenna can be fabricated from metal wiring lines, inductors and capacitors, and expensive dielectric substrates are not necessarily required. Therefore, a desired dipole antenna can be fabricated at low cost.

Preferably, the plurality of unit circuits are identical unit circuits which are periodically arranged along the extending direction of the metal wiring lines and connected with one another. In this case, the design and manufacture of the antenna can be simplified.

Preferably, the plurality of unit circuits include at least one unit circuit operable in the right-hand system and at least one unit circuit operable in the left-hand system, which are mixedly disposed in a row and connected with one another. In this case, each of the resonance mode in the right-hand system and the resonance mode in the left-hand system is preferably a resonance mode in the vicinity of n=0. This configuration enables fabrication of a broadband antenna. This is because as the frequency of the electromagnetic waves decreases, the wavelength increases in the right-hand system and decreases in the left-hand system. Because of the changes in the opposite directions, when left-hand-system unit circuits and right-hand-system unit circuits are mixedly provided, the amounts by which the antenna length must be changed in accordance with a variation in frequency cancel each other out, whereby the above-described effect is attained.

Preferably, the opposite ends of each metal wiring line are open ends. That is, the opposite ends of each metal wiring line are not short-circuited but are opened. In this case, when $|n|$ becomes 1 and an 8-shaped directivity pattern is obtained, the magnitude of current in the vicinity of the feeding portion of the antenna increases; i.e., the antinode of the resonance is located in the vicinity of the feeding portion at the center, so that generation or increase of reflection waves at the feeding portion can be well suppressed. Accordingly, good input characteristics of the antenna can be secured.

Preferably, each of the unit circuits includes a second inductor which is connected in series to the first capacitor. This second inductor is provided in order to increase the above-described stray inductance. Preferably, the connection portion of each of the unit circuits includes a second capacitor which is connected in parallel to the first inductor. This second capacitor is provided in order to increase the above-described stray capacitance. These configurations facilitate design of the left-hand-system circuit.

In the dipole antenna of the present invention, the inductor may be formed by means of a meandering inductor pattern. Even when the metal wiring lines are formed by means of conductor patterns and the inductor of each unit circuit is formed by means of a meandering inductor pattern, the antenna-length shortening ratio $\alpha d$ can be set to a desired value. Therefore, even an antenna to be used in a band of several GHz can be fabricated to have a reduced size. Moreover, when the capacitor is formed by means of a comb-shaped interdigital capacitor pattern, the dipole antenna of the present invention can be formed on an inexpensive substrate having a low dielectric constant.

In the dipole antenna of the present invention, the capacitor may be formed by means of a comb-shaped interdigital capacitor pattern. Even when the metal wiring lines are formed by means of conductor patterns and the capacitor of each unit circuit is formed by means of a comb-shaped interdigital capacitor pattern, the antenna-length shortening ratio $\alpha d$ can be set to a desired value. Therefore, even an antenna to be used in a band of several GHz can be fabricated to have a reduced size. Moreover, when the capacitor is formed by means of a comb-shaped interdigital capacitor pattern, the dipole antenna of the present invention can be formed on an inexpensive substrate having a low dielectric constant.

The capacitor and the inductor may be formed from concentrated-constant elements. In this case, since an antenna can be formed from metal wiring lines and chip elements, a desired dipole antenna can be fabricated at lower cost.

Preferably, the dipole antenna of the present invention is formed through formation of conductor patterns on a surface of a dielectric substrate, the inductor is formed by means of a meandering inductor pattern which is one of the conductor patterns, and the capacitor is formed by means of a comb-shaped interdigital inductor pattern which is one of the conductor patterns. In this case, a desired antenna can be formed from a relatively inexpensive dielectric substrate and conductor patterns. Therefore, both price reduction and thickness reduction of the antenna can be easily achieved.

Alternatively, the dipole antenna of the present invention is formed through formation of conductor patterns on a surface of a dielectric substrate with resultant formation of exposure patterns of exposed surfaces of the dielectric substrate, the inductor is formed by means of a meandering exposure pattern which is one of the exposure patterns, and the capacitor is formed by means of a comb-shaped interdigital exposure pattern which is one of the exposure patterns. In this case, according to the known Babinet principle, there can be easily formed a planar antenna having characteristics comparable to those of the above-described dipole antenna of the present invention.

In the dipole antenna of the present invention, the opposite ends of each metal wiring line may be connected with each other so as to arrange the unit circuits in a loop pattern. In this case, a non-directional loop antenna having a resonance mode of n=0 can be formed. Further, in some cases, a small loop antenna which has an 8-shaped directivity pattern in a resonance mode of n=−2 can be obtained.

BRIEF DESCRIPTION OF THE DRAWINGS

FIG. 1 is a plan view of an antenna according to a first embodiment;

FIG. 2A is a graph showing the relation between frequency f and the imaginary part β of propagation constant (β≦0);

FIG. 2B is a graph showing the relation between frequency f and the imaginary part β of propagation constant (β>0);

FIG. 3A is a graph showing the relation between wavelength λ and frequency f (β≦0);

FIG. 3B is a graph showing the relation between wavelength λ and frequency f (β>0);

FIG. 4A shows a near-field electromagnetic field distribution of the antenna of the first embodiment (n=−1);

FIG. 4B shows a near-field electromagnetic field distribution of the antenna of the first embodiment (n=−2);

FIG. 4C shows a near-field electromagnetic field distribution of the antenna of the first embodiment (n=−3);

FIG. 4D shows a near-field electromagnetic field distribution of the antenna of the first embodiment (n=−4);

FIG. 4E shows a near-field electromagnetic field distribution of the antenna of the first embodiment (n=−5);

FIG. 4F shows a near-field electromagnetic field distribution of the antenna of the first embodiment (n=−6);

FIG. 5 is a conceptual diagram used for describing decomposition and composition of respective modes of the antenna of the first embodiment;

FIG. 6 is a graph illustrating the directivity of the antenna of the first embodiment on an x-y plane;

FIG. 7 is a plan view of an antenna of a second embodiment;

FIG. 8 is a plan view of an antenna of a third embodiment;

FIG. 9 is a plan view of an antenna of a fourth embodiment;

FIG. 10 is a plan view of an antenna of a fifth embodiment;

FIG. 11 is a plan view of an antenna of a sixth embodiment;

FIG. 12 is a plan view of an antenna of a seventh embodiment;

FIG. 13A is a plan view illustrating a meandrous inductor pattern;

FIG. 13B is a plan view illustrating a comb-shaped interdigital capacitor pattern;

FIG. 14 is a plan view of an antenna of an eighth embodiment;

FIG. 15 is a plan view of an antenna of a ninth embodiment;

FIG. 16 is a plan view of an antenna of a tenth embodiment;

FIG. 17 is a plan view showing an antenna according to a modification of the first embodiment;

FIG. 18 is a plan view showing an antenna according to a modification of the second embodiment;, FIG. 19 is a plan view showing an antenna according to a modification of the third embodiment;

FIG. 20 is a plan view showing an antenna according to a modification of the fourth embodiment; and FIG. 21 shows the structure of an antenna reduced in size according to a conventional technique.

DESCRIPTION OF THE PREFERRED EMBODIMENTS

Embodiments of the present invention will be described with reference to the drawings; however, the present invention is not limited to the embodiments.

First Embodiment

FIG. 1 is a plan view of an antenna AN1 according to a first embodiment of the present invention. Straight metal wiring lines p1 and q1, which are short-circuited to each other at their left-hand ends DL and DL' and at their right-hand ends DR and DR', form a base structure of a folded dipole. A feeding portion F composed of two feeding points FL and FR is inserted into a central portion of the metal wiring line p1. The antenna AN1 of FIG. 1 has a unit circuit U1 which has a length a and is disposed between terminals BR and BR' and terminals CR and CR'. The antenna AN1 is configured through connecting six such unit circuits U1 periodically arranged along the x-axis direction.

The unit circuit U1 includes a single inductor element LSH1 (first inductor), a single capacitor element CSH1 (second capacitor), four inductor elements LSE1 (second inductors), and four capacitor elements CSE1 (first capacitors).

As shown in an enlarged diagram (equivalent circuit diagram) in the lower half of FIG. 1, the inductor element LSH1 and the capacitor element CSH1 are connected together in parallel, and are interposed between the center points of portions of the two metal wiring lines p1 and q1, which portions constitute the transmission lines of the unit circuit U1 (i.e., between the transmission lines). Thus, a connection portion which connects a portion of the metal wiring line p1 and a portion of the metal wiring line q1 is formed in the unit circuit U1.

Further, inductor elements LSE1 (second inductors), and the capacitor elements CSE1 (first capacitors) are inserted into the portions of the two metal wiring lines p1 and q1, which portions constitute the unit circuit U1, such that a pair including one inductor element LSE1 (second inductor) and one capacitor element CSE1 (first capacitor) serially connected together is disposed at four locations in total; i.e., between the terminal BR and the corresponding center point of the unit circuit U1, between the terminal BR' and the corresponding center point of the unit circuit U1, between the terminal CR and the corresponding center point of the unit circuit U1, and between the terminal CR' and the corresponding center point of the unit circuit U1.

FIGS. 2A and 2B show the dispersion characteristic of the antenna AN1. The vertical axis represents normalized frequency $f/f_0$ obtained through normalization of frequency f with respect to the normal frequency $f_0$. The normal frequency $f_0$ and the normal wavelength $\lambda_0$ have the following relation.

$$c=f_0\cdot\lambda_0 \tag{2}$$

where c is the velocity of light.

The following relation holds between the length LL and the normal wavelength $\lambda_0$ of the antenna AN1.

$$LL=\lambda_0/2 \tag{3}$$

That is, the frequency of a half-wavelength dipole antenna placed in a free space corresponds to the above-mentioned mentioned normal frequency $f_0$. FIG. 2A shows the case where the frequency f varies between 0.15 $f_0$ and 0.35 $f_0$. FIG. 2B shows the case where the frequency f varies between 1.5 $f_0$ and 3.5 $f_0$. The horizontal axis shows the imaginary part (phase constant β) of the propagation constant, which is normalized by multiplying the phase constant β by a coefficient a/π, where a represents the arrangement period (interval) of the unit circuits U1. The graph of FIG. 2A shows the case where β falls within a negative value range ($\beta \leqq 0$), and the graph of FIG. 2B shows the case where $\beta$ falls within a positive value range ($\beta > 0$).

In each of the graphs, a solid line represents theoretical values (design values), and points indicated by "*" represent values read from the near-field electromagnetic field distribution of the antenna AN1. In the region where the phase constant $\beta$ assumes a negative value, there occurs a left-hand-system operation in which the direction of the group velocity becomes opposite that of the phase velocity. Further, the operation frequency f in the region where the phase constant $\beta$ becomes negative (FIG. 2A) is lower than the operation frequency f in the region where the phase constant $\beta$ becomes positive (FIG. 2B). These graphs show that the size of the antenna AN1 of the first embodiment can be reduced in the region where the phase constant $\beta$ becomes negative ($\beta \leqq 0$).

In the antenna AN1 of the first embodiment, the inductor element LSH1 and the inductor elements LSE1 have inductances of 800 nH and 0.6 nH, respectively, and the capacitor element CSH1 and the capacitor elements CSE1 have capacitances of 1.5 pF and 2 pF, respectively. Further, the length a of the unit circuits U1 is set to about $0.05\lambda_0$.

In FIG. 1, in order to facilitate understanding of the structure, the antenna AN1 is depicted as having six unit circuits U1. However, the frequency characteristic shown in FIGS. 2A and 2B was obtained by use of an antenna having a structure identical to that of the antenna AN1 but having ten unit circuits U1. Similarly, the characteristics shown in FIGS. 3, 4, and 6, which will be described later, were obtained by use of the antenna including ten unit circuits U1.

FIGS. 3A and 3B each show the relation between normalized wavelength ($\lambda/\lambda_0$) and normalized frequency ($f/f_0$). Notably, FIG. 3A shows the wavelength vs. frequency relation for the case where the phase constant $\beta$ becomes negative, and FIG. 3B shows the wavelength vs. frequency relation for the case where the phase constant $\beta$ becomes positive.

In each of the graphs, a solid line represents theoretical values (design values), and points indicated by "*" represent values read from the near-field electromagnetic field distribution of the antenna AN1. In the region where the phase constant $\beta$ becomes negative (FIG. 3A), there can be observed a characteristic such that when the frequency f becomes lower, the wavelength $\lambda$ becomes shorter, which has not been observed in the conventional right-hand system.

Like conventional antennas, the antenna AN1 resonates when its antenna length LL becomes $\alpha d \cdot |n|/2$ times the free-space wavelength (c/f) of electromagnetic waves to be handled. However, the antenna AN1 differs from conventional antennas in that n assumes not only a positive value but also a negative value. Specifically, in the region where the phase constant $\beta$ becomes negative, n assumes a negative value, and as the frequency f decreases, the value of $|n|$ increases ($n=-1, -2, -3, \ldots$). Meanwhile, in the region where the phase constant $\beta$ becomes positive, n assumes a positive value, and as the frequency f increases, the value of $|n|$ increases ($n=1, 2, 3, \ldots$).

FIGS. 4A to 4F each show a near-field electromagnetic field distribution at the time when the antenna AN1 resonates. FIG. 4A shows that a resonance of $n=-1$; i.e., a half-wavelength resonance, occurs. The frequency at that time is 0.343 $f_0$. This demonstrates that, as compared with a half-wavelength dipole antenna in a free space, the length LL of the antenna AN1 at the time of $n=-1$; i.e., $|n|=1$, becomes 0.343·times a half of the free-space wavelength (c/f) of electromagnetic waves to be handled; that is, the shortening ratio $\alpha d$ is 0.343.

FIG. 4B shows that a resonance of $n=-2$; i.e., a full-wavelength resonance, occurs. The frequency at that time is 0.332 $f_0$, which is lower than that at the time of $n=-1$. Similarly, FIGS. 4C to 4F show near-field electromagnetic field distributions at the times of $n=-3$, $-4$, $-5$, and $-6$, respectively. In these cases, resonances of 1.5 wavelengths, 2 wavelengths, 2.5 wavelengths, and 3 wavelengths occur, and the frequency f decreases as the value of $|n|$ increases.

As described above, according to the structure (antenna AN1) of the first embodiment of the present invention, an antenna which is smaller than conventional antennas can be manufactured at low cost.

Decomposition/composition of respective modes of the antenna AN1 will be described with reference to FIG. 5. When the directivity of the antenna AN1 is considered, current involved in a resonance is decomposed to components of respective modes as shown in FIG. 5.

For example, currents flowing through the metal wiring lines p1 and q1 that constitute the antenna AN1 have different magnitudes (I). This can be decomposed into a radiation mode (II) in which currents flow through the metal wiring lines p1 and q1 in the same direction, and a transmission mode (III) in which currents flow through the metal wiring lines p1 and q1 in opposite directions. Further, in the radiation mode, the metal wiring lines p1 and q1 become equivalent to a single metal conductor (II'). Accordingly, when the directivity of the antenna AN1 is considered, consideration of only the radiation mode (II or II') is required.

FIG. 6 shows the directivity of the antenna AN1 on an x-y plane when $n=-1$ and $f=0.343\ f_0$. The antenna AN1 has an 8-shaped directivity pattern in which the maximum radiation direction coincides with the y-axis direction. This is because the current distribution in the radiation mode (II or II') shown in FIG. 5 is a sinusoidal distribution.

Second Embodiment

FIG. 7 shows an antenna AN2 according to a second embodiment. As compared with the antenna AN1, the antenna AN2 includes a reduced number of inductor elements and a reduced number of capacitor elements. In the antenna AN1, serially connected inductor elements LSE1 and capacitor elements CSE1 are interposed in both the metal wiring lines p1 and q1. In-contrast, in the antenna AN2, serially connected-inductor elements LSE2 and capacitor elements CSE2 are interposed only in one metal wiring line p1. Further, in the antenna AN1 of FIG. 1, two inductor elements LSE1 and two capacitor elements CSE1 are serially interposed between the center points of adjacent unit circuits U1. In contrast, in the antenna AN2, a single inductor element LSE2 and a single capacitor element CSE2 are interposed between the center points of adjacent unit circuits U1.

The inductance of inductor elements LSE2' located near the opposite ends (e.g., point DR) of the periodic structure is set to 0.5 times the inductance of the inductor elements LSE2. The capacitance of capacitor elements CSE2' located near the opposite ends (e.g., point DR) of the periodic structure is set to 2 times the capacitance of the capacitor elements CSE2. The reason why the conditions regarding the structure and values differ from those of other intermediate unit circuits is that the unit circuits at the feed portion and the poles (end portions) have input-output boundary conditions different from those of the remaining unit circuits.

However, by means of such a structure (that of the antenna AN2) as well, an antenna which is smaller than conventional antennas can be manufactured at low cost.

In the antenna AN2, concentrated-constant elements are not interposed in the metal wiring line q1. However, first and second unit circuits which are mutually symmetrical with respect to a center line of the antenna extending along the x-axis direction (that is, a straight line passing through the midpoint of the side DL-DL' and the midpoint of the side DR-DR') may be interposed at respective positions such as CL, BL, BR, and CR. In such a case, the concentrated-constant elements (the first capacitor and the second inductor) are alternately disposed on the metal wiring line q1 and the metal wiring line p1 at intervals corresponding to the length a (length of the unit circuits as measured along the x-axis direction).

Through introduction of a periodic structure in which upper and lower halves of unit circuits are alternatively switched to form a symmetric configuration, the action and effects of the present invention can be attained in some cases.

Third Embodiment

FIG. 8 shows a plan view of an antenna AN3 according to a third embodiment. The antenna AN3 differs from the antenna AN2 in that three metal wiring lines (transmission lines which form the base structure) are provided parallel to the x-axis direction. Pairs each including an inductor element LSH3 and a capacitor element CSH3 connected in parallel are disposed between metal wiring lines p3 and q3 and between the metal wiring line p3 and another metal wiring line r3. Pairs each including an inductor element LSE3 and a capacitor element CSE3 connected in series and pairs each including an inductor element LSE3' and a capacitor element CSE3' connected in series are interposed in the metal wiring line p3.

Even when a dipole antenna (the antenna AN3) is constructed in this manner, the action and effects of the present invention can be attained.

Fourth Embodiment

The unit circuit U1 of the antenna AN1 according to the first embodiment includes the second inductors (LSE1) and the second capacitor (CSH1) according to the present invention. However, the unit circuit of the antenna of the present invention does not necessarily include the second inductor and the second capacitor. FIG. 9 shows a plan view of an antenna AN4 according to a fourth embodiment. The unit circuit U4 of this antenna AN4 is formed through omission (elimination) of the second inductors (LSE1) and the second capacitor (CSH1) from the unit circuit U1 of the antenna AN1 according to the first embodiment.

That is, first capacitors CSE4 of the unit circuit U4 of the antenna AN4 correspond to the first capacitors CSE1 of the unit circuit U1 of the antenna AN1, and a first inductor LSH4 of the unit circuit U4 of the antenna AN4 corresponds to the first inductor LSH1 of the unit circuit U1 of the antenna AN1.

Further, stray inductances on the metal wiring lines p1 and q1 of the unit circuit U4 of the antenna AN4 correspond to the second inductors LSE1 of the unit circuit U1 of the antenna AN1, and a stray capacitance between the metal wiring lines p1 and q1 of the unit circuit U4 of the antenna AN4 corresponds to the second capacitor CSH1 of the unit circuit U1 of the antenna AN1.

In other words, a target dipole antenna involving operation in the left-hand system ($\beta \leqq 0$) can be designed through optimization of the distance between the metal wiring lines p1 and q1, as well as the length, thickness, shape, material, etc. of these metal wiring lines. Even when a dipole antenna (antenna AN4) is constructed in this manner, the action and effects of the present invention can be attained.

Fifth Embodiment

FIG. 10 is a plan view of the antenna AN21 of the fifth embodiment. This antenna AN21 can be obtained from the antenna AN4 of FIG. 9 through modification such that the opposite ends of the antenna AN4 are cut to form open ends, and all the 12 capacitors CSE4 are removed from the lower metal wiring line q1; i.e., the metal wiring line on which the feeding portion F is not provided.

As a result of removal of the capacitors from the metal wiring line q1, standing waves (currents) produced on the two wiring lines become asymmetric with each other. Since the standing wave produced on the metal wiring line (p1) having the feeding portion F is opposite in phase to the standing wave produced on the metal wiring line (q1) on which the feeding portion F is not provided, the above-described structure effectively increases the amount of radiation from a desired antenna.

Further, when the opposite ends of a dipole antenna are cut to form open ends in the above-described manner, the crest of the standing wave is located at the feeding portion F, whereby reflection of power at the feeding portion F can be effectively reduced. Therefore, the antenna AN21 of the fifth embodiment can effectively improve the input impedance at the feeding portion F and the sensitivity of the antenna.

The resonance characteristics in resonance modes can be obtained from FIGS. 4A to 4F. That is, FIGS. 4A to 4F show electromagnetic field distributions measured near an antenna. However, when the opposite ends of the antenna are cut to form open ends in the above-described manner, FIGS. 4A to 4F show magnetic field distributions in respective resonance modes. That is, in the first embodiment, electromagnetic field distributions near the antenna are shown by use of FIGS. 4A to 4F. However, the resonance characteristics of the antenna AN21 of the fifth embodiment in respective resonance modes (n=−1 to −6) can be read from FIGS. 4A to 4F by reading them while considering that FIGS. 4A to 4F represent magnetic field distributions rather than electromagnetic distributions. Especially, it is understood that the resonance mode of n=−1 is realized from FIG. 4A.

Sixth Embodiment

FIG. 11 is a plan view of an antenna AN22 of a sixth embodiment. This antenna AN22 can be obtained from the antenna AN4 of FIG. 9 through modification such that the opposite ends of the antenna AN4 are cut to form open ends, and all the 12 capacitors CSE4, provided on the lower metal wiring line q1; i.e., the metal wiring line on which the feeding portion F is not provided, are replaced with inductors LSE22. In other words, the antenna AN22 of the sixth embodiment is an improvement of the antenna AN21 of FIG. 10, and can be obtained through addition (insertion) of inductors LSE22 in the metal wiring line q1 at positions corresponding to those of the capacitors CSE21 on the metal wiring line p1.

In this configuration, the impedance at the feeding portion F can be controlled to an optimal value through proper adjustment of the values of shunt inductors LSH22, the series inductors LSE22, and series capacitors CSE22. In addition, the amount of radiation from the antenna can be increased by virtue of the above-described action of the antenna AN21. Accordingly, this configuration realizes an antenna whose reflection at the feeding portion F is very small.

In the case of the antenna AN21 of the fifth embodiment, increasing the impedance at the feeding portion F to 45 Ω or higher is difficult. However, in the case of the antenna AN22 of the sixth embodiment, the impedance at the feeding portion F can be set to about 50 Ω, by virtue of the effect of disposition of the inductors LSE22.

Seventh Embodiment

In the graph of FIG. 2A ((β≦0) regarding the antenna AN1 of the first embodiment, the frequency f at the intercept of the vertical axis at β=0 is 0.347 $f_0$. In the graph of FIG. 2B ((β>0) regarding the antenna AN1 of the first embodiment, the frequency f at the intercept of the vertical axis at β=0 is 1.92 $f_0$. That is, the values at these intercepts differ from each other, and radio waves do not propagate in a frequency band (0.347 $f_0$ to 1.92 $f_0$) between these intercepts.

However, the coordinates of the respective intercepts at β=0 of the two graphs can be rendered coincident with each other through proper adjustment of the values of the inductances and capacitances of each unit circuit of the antenna AN1. By virtue of such setting, the above-mentioned frequency band in which radio waves do not propagate can be eliminated, and the phase constant β can be changed continuously and monotonously with the frequency f across both the regions (β≦0 and 0<β). That is, according to this structure, a broadband antenna which covers the frequency ranges seamlessly can be manufactured. In this case, a resonance corresponding to n=0 occurs.

An antenna AN23 of a seventh embodiment has a resonance mode of n=0 which is realized through the above-described proper adjustment.

In the resonance mode of n=0 obtained through the above-mentioned proper adjustment, the wave has uniform phases at respective points of the antenna. Therefore, when such a structure is employed, a long antenna which has a length approximately corresponding to ten wavelengths and through which the phase becomes uniform can be formed. By virtue of this structure, there can be formed an antenna which has an 8-shaped radiation pattern in which the main lobes are narrowed and is stable in operation, and which has high sensitivity.

Even when a short, small antenna is formed, at the resonance mode of n=0, the phase becomes uniform through the antenna, and no resonance node occurs on the antenna. Therefore, even when the antenna is formed to have a reduced size, it has a long effective length. Similarly, the resonance mode of n=0 can be realized in the first to sixth embodiments.

FIG. 12 shows a plan view of an antenna AN23 of a seventh embodiment. The antenna A21 of FIG. 10 includes six identical unit circuits (length: a). In contrast, in the antenna AN23 of the seventh embodiment, four unit circuits UL operating in the left-hand system and two unit circuits UR operating in the right-hand system are mixedly disposed to be symmetric with respect to the right-left direction.

This antenna AN23 operates in the resonance mode of n=0, and its operation frequency will be referred to as "frequency fn0." Each of the left-hand-system unit circuits UL used here is composed of an inductor LSHL and capacitors CSEL, and-the values of the inductor LSHL and the capacitors CSEL are determined such that the operation frequency of the unit circuit UL itself becomes fn0+Δf.

Similarly, each of the right-hand-system unit circuits UR used here is composed of an inductor LSHR and capacitors CSER, and the values of the inductor LSHR and the capacitors CSER are determined such that the operation frequency of the unit circuit UR itself becomes fn0−Δf.

In this configuration, as the frequency decreases, the wavelength decreases in the left-hand system (unit circuit UL), and the wavelength increases in the right-hand system (unit circuit UR), so that variations in the both systems can cancel each other out. Therefore, through employment of a configuration in which left-hand-system unit circuits and right-hand-system unit circuits are mixedly provided as described above, there can be formed an antenna which can receive radio waves in a wider band even when the overall length of the antenna (antenna length LL in FIG. 12) is maintained constant.

Eighth Embodiment

In the above-described embodiments, inductors are formed from chip elements. However, each of the inductors on the respective unit circuits can be formed by use of, for example, a meandering inductor pattern Lp as shown in FIG. 13A. Similarly, each of the capacitors on the respective unit circuits can be formed by use of, for example, comb-shaped interdigital capacitor patterns Cp1 and Cp2 as shown in FIG. 13B.

Next, there will be described antennas which use such conductor patterns formed on a dielectric substrate.

FIG. 14 shows a plan view of an antenna AN24 of an eighth embodiment. This antenna A24 is the same as the antenna AN21 of FIG. 10 but is formed on a dielectric substrate d24. Each inductor and each capacitor are formed by means of a meandering inductor pattern Lp24 and an interdigital capacitor pattern Cp24, respectively, as in the example shown in FIGS. 13A and 13B. The two metal wiring lines are formed by means of strip patterns p24 and q24.

By virtue of this structure, the antenna of the present invention can be formed on an inexpensive substrate (dielectric substrate d24) having a low dielectric constant. Thus, even antennas used in a band of several GHz can be reduced in size and price.

Ninth Embodiment:

FIG. 15 shows a plan view of an antenna AN25 of a ninth embodiment. This antenna A25 has a configuration similar to the antenna AN24 of FIG. 14, but the conductor patterns (strip patterns) and exposure patterns (slot patterns) of exposed areas of the surface of the dielectric substrate are formed as negative images of those in the antenna AN24. That is, in the antenna AN25, meandering inductor patterns Lp25, interdigital capacitor patterns Cp25, and slot patterns p25 and q25 are formed by means of corresponding exposure patterns of the exposed areas of the surface of the dielectric substrate. The feeding portion F is connected to a coplanar line. That is, in the antenna AN25, the tip end S of the center conductor pattern serves as an input end for reception of a desired signal, and conductor patterns G on opposite sides of the tip end S are connected to the ground.

By virtue of this configuration, a compact RF tag or the like can be formed through formation of the antenna AN25 in the ground of an RF circuit.

Tenth Embodiment

FIG. 16 shows a plan view of an antenna AN26 of a tenth embodiment. This antenna AN26 is a loop antenna formed by connecting together the opposite ends (DL and DR, and DL' and DR') of the antenna AN21 of FIG. 10. However, the antenna AN26 includes 12 unit circuits (for 12 periods), which are substantially identical to the unit circuits of the antenna AN21.

In general, when the circumferential length of a loop antenna is equal to one wavelength, the antenna has an 8-shaped directivity as measured in a plane including the loop. However, in the case of the antenna AN26 configured as described above, if the values of an inductor LSH26 and an capacitor CSE26 are determined such that the resonance mode of n=0 is excited, the directivity as measured in a plane including the loop becomes non-directional even when the loop length of the antenna becomes approximately equal to one wavelength.

Further, in general, when the circumferential length of a loop antenna is less than half the wavelength, forming into an 8-shaped pattern the directivity as measured in a plane including the loop is difficult. However, when the configuration of the antenna AN26 is used, the resonance mode of n=−2 can be excited. In this case, even in a small loop antenna whose loop length is less than half the wavelength, an 8-shaped directivity can be realized in which an 8-shaped directivity pattern is observed in a plane including the loop.

In the antenna AN26 of FIG. 16, the feeding portion F is provided on the outer metal wiring line p1. However, the feeding portion F may be provided on the inner metal wiring line q1. However, in such a case, it is desired to dispose the above-mentioned capacitors CSE26 only on the inner metal wiring line q1 on which the feeding portion F is provided. By virtue of this configuration, the input impedance at the feeding portion F can be well secured.

OTHER MODIFICATIONS

The present invention is not limited to the above-described embodiments, and the embodiments may be modified as shown below. The antennas according to these modifications can provide actions and effects similar to those attained by the above-described embodiments.

First Modification

An antenna AN27 of FIG. 17 is obtained by cutting the opposite ends of the antenna AN1 of FIG. 1 to form open ends. In this modification as well, the input impedance at the feeding portion of the antenna can be improved by virtue of operation and effects described in the fifth embodiment.

An antenna AN28 of FIG. 18, an antenna AN29 of FIG. 19, and an antenna AN30 of FIG. 20 are obtained from the antenna AN2 of FIG. 7, the antenna AN3 of FIG. 8, and the antenna AN4 of FIG. 9, respectively, by cutting the opposite ends of each antenna to form open ends. In these modifications as well, the input impedance at the feeding portion of the antenna can be improved by virtue of operation and effects described in the fifth embodiment.

Second modification

In the above-described modified embodiments (antennas AN27, AN28, AN29, and AN30), portions of each antenna near the opposite ends may be removed such that inductors form the opposite ends. Alternatively, opposite ends of each antenna are closed by use of inductors to thereby form a dipole antenna having a pseudo folded configuration.

Third modification:

In the antenna AN24 of FIG. 14, a portion of the conductor patterns may be formed on the reverse surface of the dielectric substrate d24. For example, the strip line q24 formed of a conductor pattern may be formed on the reverse surface.

What is claimed is:

1. A dipole antenna comprising:

a plurality of generally parallel metal wiring lines; and a plurality of identical or similar unit circuits arranged in a row along the extending direction of the metal wring lines and connected with one another, wherein each unit circuit includes a connection portion for connecting the metal wiring lines together via at least one first inductor, and at least one first capacitor inserted into at least one of the metal wiring lines.

2. A dipole antenna according to claim 1, wherein the plurality of unit circuits are identical unit circuits which are periodically arranged along the extending direction of the metal wiring lines and connected with one another.

3. A dipole antenna according to claim 2, wherein the opposite ends of each metal wiring line are open ends.

4. A dipole antenna according to claim 3, wherein the connection portion of each of the unit circuits includes a second capacitor which is connected in parallel to the first inductor.

5. A dipole antenna according to claim 2, wherein each of the unit circuits includes a second inductor which is connected in series to the first capacitor.

6. A dipole antenna according to claim 2, wherein the connection portion of each of the unit circuits includes a second capacitor which is connected in parallel to the first inductor.

7. A dipole antenna according to claim 1, wherein the plurality of unit circuits include at least one unit circuit operable in the right-hand system and at least one unit circuit operable in the left-hand system, which are mixedly disposed in a row and connected with one another.

8. A dipole antenna according to claim 7, wherein the opposite ends of each metal wiring line are open ends.

9. A dipole antenna according to claim 8, wherein said first capacitor inserted into only first metal wiring line on which a feeding portion is provided.

10. A dipole antenna according to claim 8, wherein only said first capacitor inserted into only first metal wiring line on which a feeding portion is provided and said connecting portion comprises only said first inductor.

11. A dipole antenna according to claim 10, wherein a capacitance of said first capacitor and an inductance of said first inductor are adjusted so that a resonance mode of n=0 is occured.

12. A dipole antenna according to claim 7, wherein each of the unit circuits includes a second inductor which is connected in series to the first capacitor.

13. A dipole antenna according to claim 7, wherein the connection portion of each of the unit circuits includes a second capacitor which is connected in parallel to the first inductor.

14. A dipole antenna according to claim 1, wherein the opposite ends of each metal wiring line are open ends.

15. A dipole antenna according to claim 14, wherein each of the unit circuits includes a second inductor which is connected in series to the first capacitor.

16. A dipole antenna according to claim 14, wherein the connection portion of each of the unit circuits includes a second capacitor which is connected in parallel to the first inductor.

17. A dipole antenna according to claim 14, wherein the dipole antenna is formed through formation of conductor patterns on a surface of a dielectric substrate, the inductor is formed by means of a meandering inductor pattern which is one of the conductor patterns, and the capacitor is formed by means of a comb-shaped interdigital inductor pattern which is one of the conductor patterns.

18. A planar antenna obtained by modifying the dipole antenna according to claim 17, wherein the inductor is formed by means of a meandering exposure pattern which is one of exposure patterns of exposed surfaces of the dielectric substrate formed as a result of formation of the conductor patterns; and the capacitor is formed by means of a comb-shaped interdigital exposure pattern which is one of the exposure patterns.

19. A dipole antenna according to claim 17, wherein a capacitance of said first capacitor and an inductance of said first inductor are adjusted so that a resonance mode of n=−1 is occured.

20. A dipole antenna according to claim 14, wherein said first capacitor inserted into only first metal wiring line on which a feeding portion is provided.

21. A dipole antenna according to claim 20, wherein two second metal wiring lines having a capacitor, an inductor and a feeding point are not provided on each of the both side parallel to said first metal wiring line.

22. A loop antenna obtained by modifying the dipole antenna according to claim 20, wherein the opposite ends of each metal wiring line are connected with each other so as to arrange the unit circuits in a loop pattern.

23. A dipole antenna according to claim 14, wherein only said first capacitor inserted into at least one of the metal wiring lines and said connection portion comprises only said first inductor.

24. A dipole antenna according to claim 14, wherein said first capacitor inserted into only first metal wiring line on which a feeding portion is provided and said connecting portion comprises only said first inductor.

25. A dipole antenna according to claim 14, wherein only said first capacitor inserted into only first metal wiring line on which a feeding portion is provided and said connecting portion comprises only said first inductor.

26. A dipole antenna according to claim 25, wherein the dipole antenna is formed through formation of conductor patterns on a surface of a dielectric substrate, the inductor is formed by means of a meandering inductor pattern which is one of the conductor patterns, and the capacitor is formed by means of a comb-shaped interdigital inductor pattern which is one of the conductor pattern.

27. A dipole antenna according to claim 26, wherein the inductor is formed by means of a meandering exposure pattern which is one of exposure patterns of exposed surfaces of the dielectric substrate formed as a result of formation of the conductor patterns; and the capacitor is formed by means of a comb-shaped interdigital exposure pattern which is one of the exposure patterns.

28. A dipole antenna according to claim 25, wherein only second inductor is inserted into only the metal wiring line on which no feeding portion is provided.

29. A dipole antenna according to claim 25, wherein a capacitance of said first capacitor and an inductance of said first inductor are adjusted so that a resonance mode of n=−1 is occured.

30. A loop antenna obtained by modifying the dipole antenna according to claim 25, wherein the opposite ends of each metal wiring line are connected with each other so as to arrange the unit circuits in a loop pattern.

31. A loop antenna obtained by modifying the dipole antenna according to claim 30, wherein a capacitance of said first capacitor and an inductance of said first inductor are adjusted so that a resonance mode of n=0 is occured.

32. A dipole antenna according to claim 1, wherein each of the unit circuits includes a second inductor which is connected in series to the first capacitor.

33. A dipole antenna according to claim 1, wherein the connection portion of each of the unit circuits includes a second capacitor which is connected in parallel to the first inductor.

34. A dipole antenna according to claim 1, wherein the inductor is formed by means of a meandering inductor pattern.

35. A dipole antenna according to claim 1, wherein the capacitor is formed by means of a comb-shaped interdigital capacitor pattern.

36. A dipole antenna according to claim 1, wherein the capacitor and the inductor are formed from concentrated-constant elements.

37. A loop antenna obtained by modifying the dipole antenna according to claim 1, wherein the opposite ends of each metal wiring line are connected with each other so as to arrange the unit circuits in a loop pattern.

* * * * *

UNITED STATES PATENT AND TRADEMARK OFFICE

CERTIFICATE OF CORRECTION

PATENT NO. : 7,265,730 B2
APPLICATION NO. : 11/376267
DATED : September 4, 2007
INVENTOR(S) : Hideo Iizuka et al.

It is certified that error appears in the above-identified patent and that said Letters Patent is hereby corrected as shown below:

Cover Page, item (57), Abstract, line 4, change “wring” to --wiring--.

Column 14, line 19, change “wring” to --wiring--.

Column 15, line 34, change “side” to --sides--.

Signed and Sealed this

Twenty-sixth Day of August, 2008

JON W. DUDAS
*Director of the United States Patent and Trademark Office*